US011028790B2

(12) United States Patent
Kobayashi et al.

(10) Patent No.: US 11,028,790 B2
(45) Date of Patent: Jun. 8, 2021

(54) PURGE CONTROL VALVE DEVICE

(71) Applicant: HAMANAKODENSO CO., LTD., Kosai (JP)

(72) Inventors: Yasunori Kobayashi, Kosai (JP); Tetsunori Inoguchi, Kosai (JP); Younan Ri, Kosai (JP); Ryo Asaka, Kosai (JP)

(73) Assignee: HAMANAKODENSO CO., LTD., Kosai (JP)

( * ) Notice: Subject to any disclaimer, the term of this patent is extended or adjusted under 35 U.S.C. 154(b) by 0 days.

(21) Appl. No.: 16/829,003

(22) Filed: Mar. 25, 2020

(65) Prior Publication Data

US 2021/0062735 A1 Mar. 4, 2021

(30) Foreign Application Priority Data

Aug. 28, 2019 (JP) ..... JP2019-156095
Feb. 19, 2020 (JP) ..... JP2020-026491

(51) Int. Cl.
*F02D 41/00* (2006.01)
*F02M 25/08* (2006.01)

(52) U.S. Cl.
CPC ..... *F02D 41/004* (2013.01); *F02M 25/089* (2013.01); *F02M 25/0836* (2013.01); *F02M 2025/0845* (2013.01)

(58) Field of Classification Search
CPC ..... F02D 41/004; F02M 25/0836; F02M 25/089; F02M 2025/0845
USPC ..... 123/520
See application file for complete search history.

(56) References Cited

U.S. PATENT DOCUMENTS 5,289,811 A * 3/1994 Covert ..... F02M 25/0836 123/520
5,419,367 A * 5/1995 Noya ..... F02M 25/0836 137/495
2004/0011409 A1* 1/2004 Martus ..... F02M 25/0836 137/557
2005/0051142 A1* 3/2005 Zdravkovic ..... F16K 31/0655 123/520

(Continued)

FOREIGN PATENT DOCUMENTS

JP H07119558 A 5/1995
JP 2007218390 A 8/2007

(Continued)

*Primary Examiner* — Mahmoud Gimie
(74) *Attorney, Agent, or Firm* — Harness, Dickey & Pierce, P.L.C.

(57) ABSTRACT

In a purge control valve device, a purge valve includes a first electromagnetic valve and a second electromagnetic valve which are provided inside a housing. The first electromagnetic valve has a first valve body that controls a flow rate of evaporative fuel flowing in the housing. The second electromagnetic valve has a second valve body that controls a flow rate of evaporative fuel flowing in the housing. The upstream passage and the downstream passage are arranged in series. The first electromagnetic valve switches a seated state and an unseated state of the first valve body. The purge valve has a narrowed passage in which a flow rate of the evaporative fuel is smaller in one of the seated state and the unseated state than in another of the seated state and the unseated state.

18 Claims, 13 Drawing Sheets

(56) References Cited

U.S. PATENT DOCUMENTS

| | | | |
|---|---|---|---|
| 2008/0290306 | A1 | 11/2008 | Okuda |
| 2013/0042839 | A1 | 2/2013 | Takahashi et al. |

FOREIGN PATENT DOCUMENTS

| | | | |
|---|---|---|---|
| JP | 2008-291916 | A | 12/2008 |
| WO | WO-2012025958 | A1 | 3/2012 |

* cited by examiner

PURGE CONTROL VALVE DEVICE

CROSS REFERENCE TO RELATED APPLICATIONS

The present application claims the benefit of priority from Japanese Patent Application No. 2019-156095 filed on Aug. 28, 2019 and Japanese Patent Application No, 2020-026491 filed on Feb. 19, 2020. The entire disclosures of the above applications are incorporated herein by reference.

TECHNICAL FIELD

The present disclosure relates to a purge control valve device.

BACKGROUND

A purge control valve device controls a flow rate of evaporative fuel from a canister to an engine.

SUMMARY

According to at least one embodiment of the present disclosure, a purge control valve device includes: an inflow port into which the evaporative fuel flowing out of a canister flows; an outlet port through which the evaporative fuel flows out toward an engine; a housing having an in-housing passage connecting the inflow port and the outflow port; a first electromagnetic valve provided inside the housing and having a first valve body opening and closing a first internal passage included in the in-housing passage to control a flow rate of the evaporative fuel; and a second electromagnetic valve provided inside the housing and having a second valve body opening and closing a second internal passage included in the in-housing passage to control a flow rate of the evaporative fuel. The first internal passage and the second internal passage are arranged in series in the in-housing passage The first electromagnetic valve and the second electromagnetic valve are controlled to operate individually. The first electromagnetic valve is switched between a seated state in which the first valve body contacts a first valve seat and an unseated state in which the first valve body is separated from the first valve seat. The purge control valve device further includes a narrowed passage in which a flow rate of the evaporative fuel is smaller in one of the seated state and the unseated state than in another of the seated state and the unseated state.

BRIEF DESCRIPTION OF THE DRAWINGS

The details of one or more embodiments are set forth in the accompanying drawings and the description below. Other features and advantages will be apparent from the description and drawings, and from the claims.

DETAILED DESCRIPTION

Figure 1:
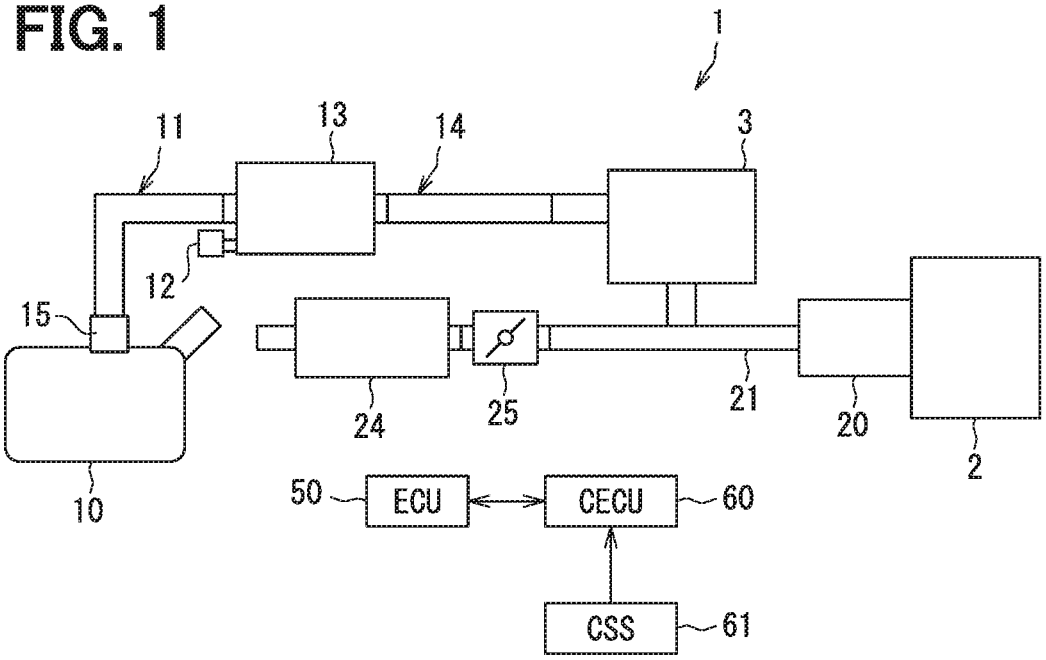
FIG. 1 is a schematic diagram illustrating an evaporative fuel processing apparatus including a purge control valve device according to at least one embodiment.

As negative pressure of a low-fuel-consumption engine decreases, and operating time of an engine of a vehicle such as a hybrid vehicle decreases, a purge valve is required to have a large flow capacity. For example, a column member may be positioned to face a housing entrance so as to reduce pulsation entering an input port and reduce decrease in flow rate. However, there is room for improvement. A purge control valve device of the present disclosure has a specific flow characteristic in order to improve the flow characteristics.

According to one aspect of the present disclosure, a purge control valve device includes: an inflow port into which the evaporative fuel flowing out of a canister flows; an outlet port through which the evaporative fuel flows out toward an engine; a housing having an in-housing passage connecting the inflow port and the outflow port; a first electromagnetic valve provided inside the housing and having a first valve body opening and closing a first internal passage included in the in-housing passage to control a flow rate of the evaporative fuel; and a second electromagnetic valve provided inside the housing and having a second valve body opening and closing a second internal passage included in the in-housing passage to control a flow rate of the evaporative fuel. The first internal passage and the second internal passage are arranged in series in the in-housing passage The first electromagnetic valve and the second electromagnetic valve are controlled to operate individually. The first electromagnetic valve is switched between a seated state in which the first valve body contacts a first valve seat and an unseated state in which the first valve body is separated from the first valve seat. The purge control valve device further includes a narrowed passage in which a flow rate of the evaporative fuel is smaller in one of the seated state and the unseated state than in another of the seated state and the unseated state.

Accordingly, the evaporative fuel flowing through the narrowed passage has a small flow rate in the one state and a large flow rate in the other state. The seated state and the unseated state can be switched such that the one state is selected when it is desired to obtain a small flow rate characteristic or to suppress pulsation, and the other state is selected when it is desired to secure a flow rate. Thus, the purge control valve device can improve flow characteristics.

According to another aspect of the present disclosure, a purge control valve device includes: an inflow port into which the evaporative fuel flowing out of a canister flows; an outlet port through which the evaporative fuel flows out toward an engine; a housing having an in-housing passage connecting the inflow port and the outflow port; a first electromagnetic valve provided inside the housing and having a first valve body opening and closing a first internal passage included in the in-housing passage to control a flow rate of the evaporative fuel; and a second electromagnetic valve provided inside the housing and having a second valve body opening and closing a second internal passage included in the in-housing passage to control a flow rate of the evaporative fuel. The first internal passage and the second internal passage are arranged in series in the in-housing passage. The first electromagnetic valve and the second electromagnetic valve are controlled to operate individually. The first electromagnetic valve is switched between a seated state in which the first valve body contacts a first valve seat and an unseated state in which the first valve body is separated from the first valve seat. The purge control valve device further includes a narrowed passage in the first internal passage such that a passage cross-sectional area of the first internal passage is smaller in one of the seated state and the unseated state than in another of the seated state and the unseated state.

Accordingly, a flow rate of the evaporative fuel can be made smaller in the one state than in the other state by the narrowed passage that reduces the passage cross-sectional area of the first internal passage. Therefore, the one state is selected when it is desired to obtain a small flow rate characteristic or to suppress pulsation while the other state is selected when it is desired to secure a flow rate. Accordingly, the passage cross-sectional area of the first internal passage can be switched, Thus, the purge control valve device can improve flow characteristics. Hereinafter, embodiments for implementing the present disclosure will be described referring to drawings. In each embodiment, portions corresponding to the elements described in the preceding embodiments are denoted by the same reference numerals, and redundant explanation may be omitted. When only a part of the configuration is described in each form, the other forms described above can be applied to the other parts of the configuration. It may be possible not only to combine parts the combination of which is explicitly described in an embodiment, but also to combine parts of respective embodiments the combination of which is not explicitly described if any obstacle does not especially occur in combining the parts of the respective embodiments.

First Embodiment

A first embodiment will be described with reference to FIGS. 1-5. A purge control valve device is used in an evaporative fuel processing apparatus 1 which is an evaporative fuel purge system mounted on a vehicle. A purge valve 3 is an example of the purge control valve device. As shown in FIG. 1, the evaporative fuel processing apparatus 1 supplies gas, such as HC gas; in fuel adsorbed by a canister 13 to an intake passage of an engine 2. Accordingly, evaporative fuel is prevented from being released from a fuel tank 10 to an outside air. The evaporative fuel processing apparatus 1 includes an intake system of the engine 2 which constitutes the intake passage of the engine 2 that is an internal combustion engine, and an evaporative fuel purge system which supplies evaporative fuel to the intake system of the engine 2.

Evaporative fuel introduced by an intake pressure into the intake passage of the engine 2 is mixed with combustion fuel supplied from an injector or the like to the engine 2 and burned in a combustion chamber of the engine 2. The engine 2 mixes at least the combustion fuel and the evaporative fuel desorbed from the canister 13, and burns the mixture. In the intake system of the engine 2, an intake pipe 21 forming the intake passage is connected to an intake manifold 20. In this intake system, a throttle valve 25 and an air filter 24 are provided in the intake pipe 21.

The fuel tank 10 and the canister 13 in the evaporative fuel purge system are connected to each other through a pipe 11 that forms a vapor passage. The canister 13 and the intake pipe 21 in the evaporative fuel purge system are connected to each other through and the purge valve 3 and a pipe 14 forming a purge passage. A purge pump may be provided in the purge passage. The air filter 24 is provided in an upstream portion of the intake pipe 21 and captures dust, dirt, etc. in intake air. The throttle valve 25 is an intake amount adjustment valve that adjusts an amount of intake air flowing into the intake manifold 20 by adjusting an opening degree of an inlet of the intake manifold 20. Intake air passes through the intake passage, and flows into the intake manifold 20. Then, the intake air is mixed with the combustion fuel injected from the injector or the like at a predetermined air-fuel ratio to be burned in the combustion chamber.

The fuel tank 10 is a container for storing fuel such as gasoline. The fuel tank 10 is connected to an inflow portion of the canister 13 by the pipe 11 forming the vapor passage. An ORVR valve 15 is provided in the fuel tank 10, The ORVR valve 15 prevents evaporative fuel in the fuel tank 10 from being discharged to the outside air from a fuel filler opening during fueling. The ORVR valve 15 is a float valve which is displaced in accordance with a fuel level. When an amount of fuel in the fuel tank 10 is small, the ORVR valve 15 is opened, and vapor is discharged from the fuel tank 10 to the canister 13 by pressure at the time of fueling. When a predetermined amount or more of fuel is present in the fuel tank 10, the ORVR valve 15 closes due to the buoyancy of the fuel, thereby preventing the evaporative fuel from flowing out toward the canister 13.

The canister 13 is a container in which an adsorbent such as activated carbon is sealed. The canister 13 takes in evaporative fuel generated in the fuel tank 10 through the vapor passage and temporarily adsorbs the evaporative fuel to the adsorbent. The canister 13 is provided with a valve module 12 integrally or through a duct. The valve module 12 includes a canister close valve and an inner pump. The canister close valve opens and closes a suction portion for drawing fresh air from the outside. Since the canister 13 includes the canister close valve, atmospheric pressure can be introduced in the canister 13. The canister 13 can easily release (i.e. purge) the evaporative fuel adsorbed to the adsorbent by the drawn fresh air.

The purge valve 3 is a purge control valve device including multiple valve bodies that open and close an in-housing passage in a housing that is a part of the purge passage. The purge control valve device has therein multiple electromagnetic valves. The purge valve 3 can permit and prevent supply of the evaporative fuel from the canister 13 to the engine 2.

During running of the vehicle, when a controller 50 performs a control such that an inflow port 31*a* communicates with an outflow port 33*a*, a pressure difference is generated between an atmospheric pressure in the canister 13 and a negative pressure in the intake manifold 20 generated by a suction action of a piston. This pressure difference makes the vaporfuel adsorbed to the canister 13 be sucked into the intake manifold 20 through the purge passage, the purge valve 3 and the intake pipe 21.

Evaporative fuel sucked into the intake manifold 20 is mixed with original combustion fuel supplied from the injector or the like to the engine 2 and burned in a cylinder of the engine 2, In the cylinder of the engine 2, the air-fuel ratio which is the mixing ratio of the combustion fuel and the intake air is controlled to be a predetermined air-fuel ratio set in advance. The controller 50 controls a first electromagnetic valve 34 by energization and de-energization thereof. The controller 50 controls a second electromagnetic valve 35 by controlling duty cycle of energization. Appropriate control of the first electromagnetic valve 34 and the second electromagnetic valve 35 by the controller 50 achieves adjustment of a purge amount of evaporative fuel so that the predetermined air-fuel ratio is maintained.

The controller 50 includes at least one processing unit (CPU) and at least one memory unit as a storage medium which stores a program and data. The controller 50 is provided by a microcontroller including a computer-readable storage medium. The storage medium is a non-transitional substantive storage medium that stores a computer-readable program in a non-temporary fashion. A semiconductor memory, a magnetic disk, or the like can serve as the storage medium. The controller 50 may be provided by a set of computer resources linked by a computer or data communication device. When executed by the controller 50, the program causes the controller 50 to function according to the description provided herein and causes the controller 50 to perform the methods described herein.

Means and/or functions provided by the controller 50 may be provided by software recorded in a substantive memory device and a computer that can execute the software, software only, hardware only, or some combination of them. For example, when the controller 50 is provided by an electronic circuit being hardware, it may be possible to provide by a digital circuit including multiple logic circuits or analog circuits.

In recent years, a negative pressure in the engine tends to decrease due to reduction in fuel consumption, and an operating time of the engine of a vehicle such as a hybrid vehicle tends to decrease. Thus, the purge valve 3 may have a performance capable of adjusting fuel at a large flow rate. If an attempt is made to increase a flow capacity of the purge valve 3, a fluctuation range of pressure in a flow path connecting the purge valve 3 and the canister 13 may increase. The increase in pressure fluctuation range may cause the pipe to vibrate due to pulsation and generate noise in the vehicle. Further, such large flow capacity of the purge valve 3 may lead to a fluttering sound of the ORVR valve 15. The pipe 14 connecting the purge valve 3 and the canister 13 is provided, for example, below a floor in a vehicle compartment. Hence, the noise due to the vibration of the pipe and the fluttering sound of the ORVR valve 15 are easily transmitted to the vehicle compartment. The evaporative fuel processing apparatus 1 has an effect of reducing the pressure fluctuation range in the flow path leading to the canister 13 and reducing the fluttering sound of the ORVR valve 15. When the purge valve 3 is increased in flow capacity, an accuracy of flow rate control is reduced, and thereby an accuracy of concentration learning of the evaporative fuel tends to be reduced. The evaporative fuel processing apparatus 1 has an effect of securing the accuracy of evaporative fuel concentration learning.

Next, configurations of the purge valve 3 will be described. The purge valve 3 includes the first electromagnetic valve 34 and the second electromagnetic valve 35 which are provided inside the housing. The first electromagnetic valve 34 and the second electromagnetic valve 35 are arranged inside the purge valve 3 in a direction from an upstream side to a downstream side. The upstream side is indicated by "US" in the drawings. The downstream side is indicated by "DS" in the drawings. The first electromagnetic valve 34 and the second electromagnetic valve 35 are arranged in a direction of displacement of a valve body of the purge valve 3 or in an axial direction of the valve body. The axial direction is indicated by "AD" in the drawings. The first electromagnetic valve 34 is located upstream of the second electromagnetic valve 35. The first electromagnetic valve 34 opens and closes a first internal passage in the purge valve 3 and adjusts a passage cross-sectional area of the first internal passage. The second electromagnetic valve 35 opens and closes a second internal passage in the purge valve 3 and adjusts a passage cross-sectional area of the second internal passage. The passage cross-sectional area is a sectional area of a passage cut along a plane orthogonal to a flow direction of fluid in the passage.

The first internal passage and the second internal passage are passages included in the in-housing passage. The first internal passage and the second internal passage are arranged in series, not in parallel, in the internal passage in the housing. In the present embodiment, the first internal passage is an upstream passage in the in-housing passage, and the second internal passage is a downstream passage in the in-housing passage. Hereinafter, the first internal passage is replaced with the upstream passage, and the second internal passage is replaced with the downstream passage.

The purge valve 3 includes, as the housing, an inflow housing 31, an outflow housing 33, and an intermediate housing 32. The inflow housing 31, the intermediate housing 32, and the outflow housing 33 are formed of, for example, a resin material. The inflow housing 31 includes the inflow port 31*a* into which evaporative fuel flows from the canister 13. The inflow port 31*a* is connected to the pipe 14 forming the purge passage of the evaporative fuel processing apparatus 1. The inflow port 31*a* communicates with the canister 13 through the pipe 14 connected to the inflow port 31*a*. The inflow housing 31 includes a flange 31*b* which is joined to a flange 32*b* of the intermediate housing 32 by welding or bonding.

The inflow port 31*a* is a part of a tubular portion that has a fluid inflow passage 31*a*1 therein, and is located at an upstream end of the inflow housing 31. A downstream portion of the tubular portion has a pipe diameter that increases in a direction toward the downstream side, and an inflow chamber is formed inside the downstream portion. The inflow chamber has a passage cross-sectional area larger than a passage in the inflow port 31*a* located upstream of the inflow chamber. The passage cross-sectional area of the inflow chamber increases in the direction toward the downstream side. A downstream end of the tubular portion is integrally formed with the flange 31*b* that protrudes radially outward.

The flange 31*b* has a first valve seat 31*b*1 on a downstream surface of the flange 31*b*. A first valve body 34*b* contacts the first valve seat 31*b*1 in a seated state of the first electromagnetic valve 34. The flange 31*b* is provided with a flow path narrowing wall 31*c* protruding downstream from the downstream surface of the flange 31*b*. The flow path narrowing wall 31*c* is located radially outward of a plate 34*b*1, and a gap is formed between the flow path narrowing wall 31*c* and an outer peripheral edge of the plate 34*b*1. The flow path narrowing wall 31*c* may surround an entire or part of the outer peripheral edge of the plate 34*b*1.

Figure 2:
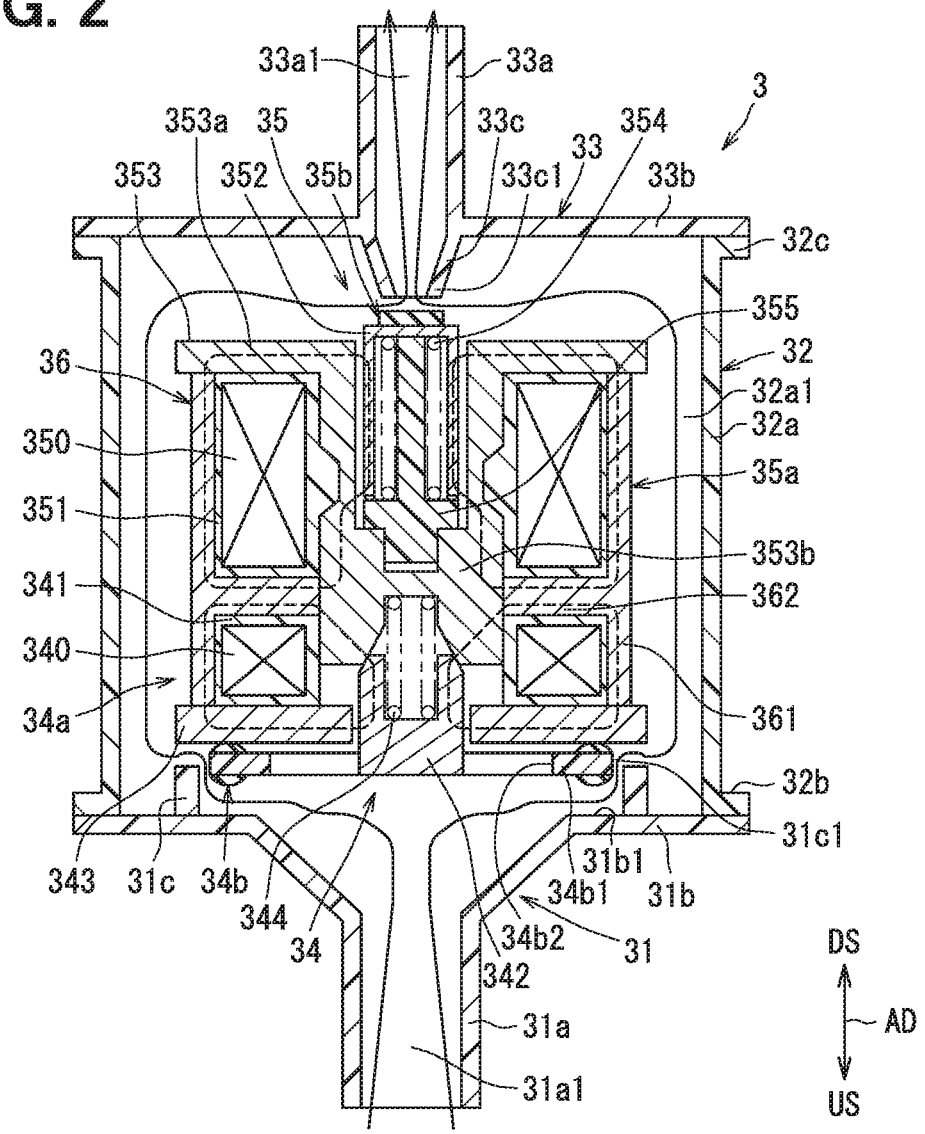
FIG. 2 is a sectional view illustrating an operation of the purge control valve device at a first increase rate, according to at least one embodiment.

As shown in FIG. 2, the gap between the outer peripheral edge of the plate 34*b*1 and the flow path narrowing wall 31*c* forms a narrowed passage 31*c*1 through which fluid flows when the first valve body 34*b* is in an unseated state. The purge valve 3 includes the narrowed passage 31*c*1 that reduces the passage cross-sectional area of the first internal passage to be smaller than that in the seated state of the first valve body 34*b*.

The narrowed passage 31*c*1 forms a passage having a passage cross-sectional area smaller than a through-hole 34*b*2. The narrowed passage 31*c*1 is configured such that fluid does not flow therethrough in the seated state of the first valve body 34*b*. When fluid flows at a first increase rate shown in FIG. 5, the narrowed passage 31*c*1 corresponds to the upstream passage of the purge valve 3 through which the fluid flows. When the fluid flows at the first increase rate in the unseated state illustrated in FIG. 2, the first valve body 34*b* is in contact with a fixed core 343. The unseated state shown in FIG. 2 can be said to be a state in which the first valve body 34*b* is seated on the fixed core 343. Accordingly, the fluid flows through the narrowed passage 31*c*1 and does not flow through the through-hole 34*b*2.

The intermediate housing 32 includes a cylindrical portion 32*a* extending in the axial direction, and flanges 32*b* and 32*c* provided at different ends of the cylindrical portion 32*a* in the axial direction. The flange 32*b* is a portion radially protruding from the upstream end of the cylindrical portion 32*a*. The flange 32*c* is a portion radially protruding from the downstream end of the cylindrical portion 32*a*.

The intermediate housing 32 houses the first electromagnetic valve 34 and the second electromagnetic valve 35. Inside the intermediate housing 32, the first electromagnetic valve 34 is provided in an upstream region, and the second electromagnetic valve 35 is provided in a downstream region. An inner peripheral surface of the intermediate housing 32 and an outer peripheral surface of the first electromagnetic valve 34 or the second electromagnetic valve 35 define an intermediate passage 32*a*1 therebetween. The intermediate passage 32*a*1 is a cylindrical passage located between the upstream passage and the downstream passage in the purge valve 3 and located outside the first electromagnetic valve 34 and the second electromagnetic valve 35. The intermediate passage 32*a*1 is larger in passage cross-sectional area than the upstream passage and the downstream passage in the purge valve 3.

The outflow housing 33 is provided with an outflow port 33*a* through which the evaporative fuel flows out toward the intake pipe 21, and a tubular portion 33*c* located upstream of the outflow port 33*a*. The outflow port 33*a* and the tubular portion 33*c* are provided coaxially. The outflow port 33*a* communicates with an inside of the intake pipe 21 through the pipe connected to the outflow port 33*a*. The outflow housing 33 includes a flange 33*b* which is joined to the flange 32*c* of the intermediate housing 32 by welding or bonding. The flange 33*b* is a portion radially protruding from the upstream end of the outflow port 33*a*.

The outflow port 33*a* is a tubular portion that has a fluid outflow passage 33*a*1 therein, and is located at a downstream end of the outflow housing 33. The outflow port 33*a* and the tubular portion 33*c* are connected by the flange 33*b*. A second valve seat 33*c*1 is provided at an upstream end of the tubular portion 33*c*. A space between the second valve seat 33*c*1 and a second valve body 35*b* corresponds to the downstream passage of the purge valve 3 through which the fluid flows toward the outflow passage 33*a*1. An upstream end of the passage in the tubular portion 33*c* communicates with the downstream passage of the purge valve 3. A downstream end of the passage in the tubular portion 33*c* communicates with the outflow passage 33*a*1, The tubular portion 33*c* has a tube diameter that decreases in a direction toward its upstream end. The passage in the tubular portion 33*c* decreases in passage cross-sectional area in the direction toward the upstream end.

The purge valve 3 has one inflow port 31*a* into which fluid flows in from outside and one outflow port 33*a* from which fluid flows out to the outside. All the fluid that has flowed into the inflow passage 31*a*1 flows through the upstream passage, the intermediate passage 32*a*1, and the downstream passage, in this order, and then flows out to the outflow passage 33*a*1, The first electromagnetic valve 34 and the second electromagnetic valve 35 each include a solenoid and a valve body, and individually form a magnetic circuit. The first electromagnetic valve 34 and the second electromagnetic valve 35 are configured such that energization of their coils are individually controlled by the controller 50.

The first electromagnetic valve 34 includes the first valve body 34*b*, and a first solenoid 34*a* that generates an electromagnetic force for displacing the first valve body 34*b*. The first valve body 34*b* is capable of adjusting a flow path resistance in the upstream passage in the purge valve 3. The first electromagnetic valve 34 shown in FIG. 2 is controlled in the unseated state in which the first valve body 34*b* is separated from the first valve seat 31*b*1. In the unseated state of the first valve body 34*b*, a flow rate of fluid increases at a small increase rate that is the first increase rate shown in the graph of FIG. 5. The first valve body 34*b* is maintained in the unseated state while the mode of the first increase rate is being performed.

Figure 3:
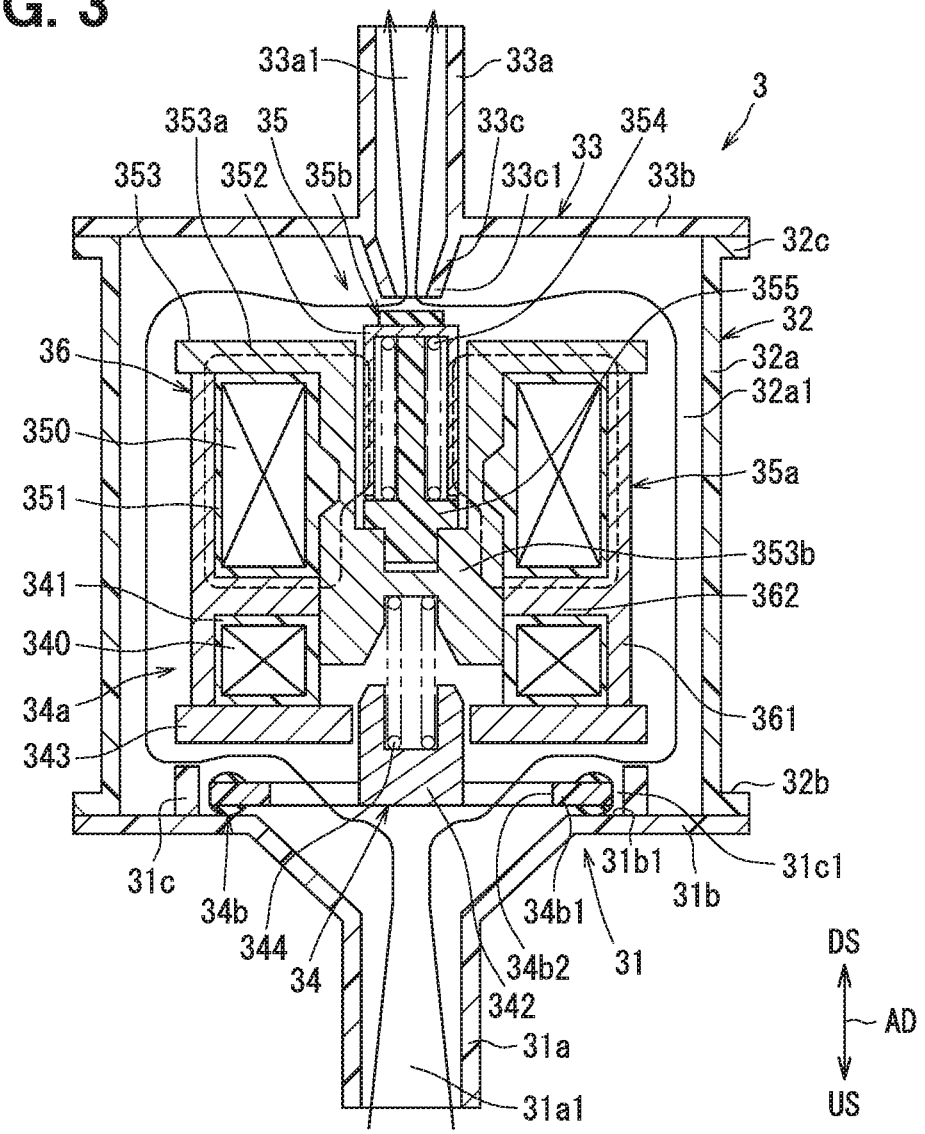
FIG. 3 is a sectional view illustrating an operation of the purge control valve device at a second increase rate, according to at least one embodiment.
Figure 5:
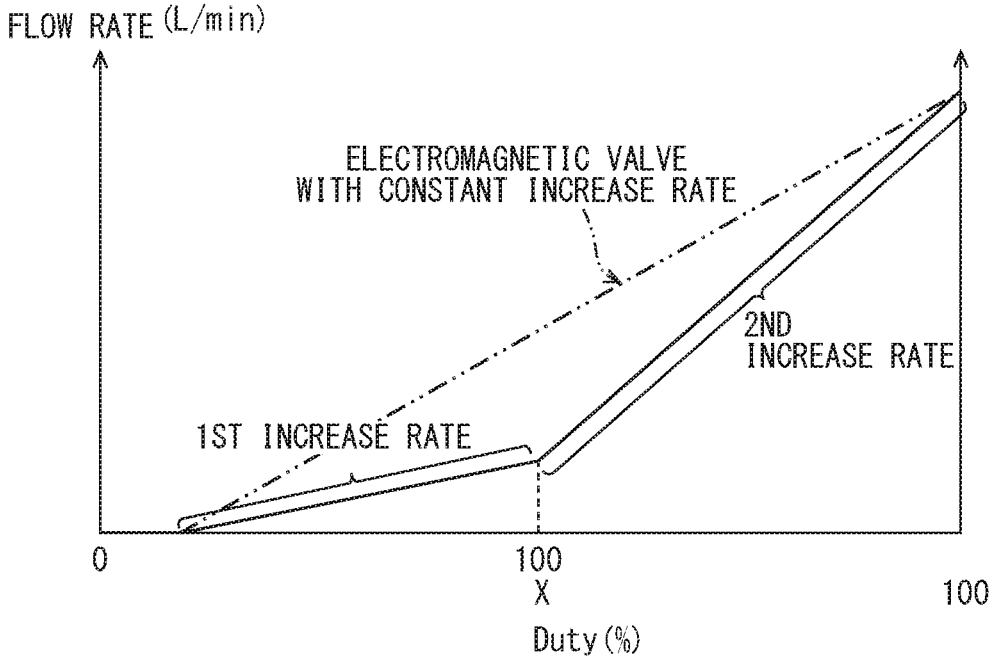
FIG. 5 is a diagram illustrating a flow rate control of the purge control valve device.

The first electromagnetic valve 34 shown in FIG. 3 is controlled in the seated state in which the first valve body 34*b* is in contact with the first valve seat 31*b*1. In the seated state of the first valve body 34*b*, the flow rate of fluid increases at the second increase rate that is larger than the first increase rate as shown in the graph of FIG. 5. The first valve body 34*b* is maintained in the seated state while the mode of the second increase rate is being performed. The first electromagnetic valve 34 is controlled in the seated state when no voltage is applied, and is controlled in the unseated state when voltage is applied. The first electromagnetic valve 34 is a normally open valve that controls small flow by narrowing the upstream passage when voltage is applied, and controls large flow by fully opening the upstream passage when no voltage is applied. The flow increase rate is, for example, an increase of the flow rate per unit time or an increase of the flow rate per unit displacement of the valve body.

The first solenoid 34*a* includes a coil 340, a bobbin 341, a movable core 342, the fixed core 343, a yoke 36, a shaft 353*b* and a spring 344, The central axis of the first solenoid 34*a* corresponds to the central axis of the first electromagnetic valve 34 and the central axis of the purge valve 3. The shaft 353*b* is a part of an axial support 353. The axial support 353 includes an annular plate 353*a* located at a downstream end of the axial support 353, and the shaft 353*b* that extends in the axial direction from an inner circumferential edge of the annular plate 353*a* toward the upstream side. The axial support 353 coaxially supports the first solenoid 34*a* and a second solenoid 35*a*.

The movable core 342 is made of a material through which magnetism passes, for example, a magnetic material. The movable core 342 has a cup-shaped body with a bottom. The movable core 342 is provided so as to surround the spring 344, and the spring 344 is disposed inside the movable core 342. The spring 344 is provided between the shaft 353*b* and the movable core 342. The spring 344 provides an urging force for moving the movable core 342 in a direction away from the shaft 353*b*. The spring 344 provides an urging force for moving the movable core 342 toward the first valve seat 31*b*1.

The first valve body 34*b* has a valve element formed of an elastically deformable material such as rubber. The valve element of the first valve body 34*b* has an annular shape surrounding both entire circumferences of an upstream surface and a downstream surface of the plate 34*b*1, The plate 34*b*1 is provided integrally with an upstream end of the movable core 342. The upstream surface of the plate 34*b*1 faces the first valve seat 31*b*1 in the axial direction. The second valve body 35*b* is provided at a downstream end of a movable core 352 and is integral with the movable core 352. The plate 34*b*1 is provided with multiple or one through-hole 34*b*2, As shown in FIG. 3, when the first valve body 34*b* is in the seated state, the through-hole 34*b*2 forms an open passage through which the fluid can flow. The purge valve 3 includes the open passage that increases the passage cross-sectional area of the first internal passage to be larger than that in the unseated state of the first valve body 34*b*, As shown in FIG. 2, when the first valve body 34*b* is in the unseated state, the through-hole 34*b*2 forms a passage through which the fluid does not flow. When fluid flows at the second increase rate shown in FIG. 5, the through-hole 34*b*2 corresponds to the upstream passage of the purge valve 3 through which the fluid flows.

The fixed core 343 slidably supports the movable core 342 that is being moved by the electromagnetic force in the axial direction against the urging force of the spring 344. The fixed core 343 is provided integrally with the bobbin 341, the coil 340, the yoke 36, and the axial support 353. The fixed core 343, the movable core 342, the first valve body 34*b*, the coil 340, and the yoke 36 are coaxial.

The bobbin 341 is formed of an insulating material and has a function of insulating the coil 340 from other parts. The fixed core 343, the movable core 342, the shaft 353*b*, and the yoke 36 are made of a material that transmits magnetism. The yoke 36 includes a cylindrical portion 361 having opposite open ends in the axial direction, and an annular plate 362 having an annular shape and provided on an inner peripheral surface of the cylindrical portion 361. The annular plate 362 is located between the coil 340 and another coil 350. When the coil 340 is energized, a magnetic circuit indicated by dash lines around the coil 340 in FIG. 2 is formed. This magnetic circuit generates an electromagnetic force that attracts the movable core 342 toward the shaft 353*b*. The electromagnetic force switches the first valve body 34*b* from the seated state to the unseated state. The magnetic circuit in the first electromagnetic valve 34 is formed by magnetism passing through the fixed core 343, the movable core 342, the shaft 353*b*, the annular plate 362, and the cylindrical portion 361. The first valve body 34*b* is driven in accordance with a balance between the electromagnetic force generated upon energization of the coil 340 and the urging force of the spring 344, and is thereby switched between the seated state and the unseated state.

The housing is provided with a first connector having a terminal for energization of the coil 340 of the first electromagnetic valve 34. The terminal built in the first connector is a current-carrying terminal electrically connected to the coil 340. The first connector is connected to a power supply connector for power supply from a power source unit or a current controller. The first connector and the power supply connector are connected, and the terminal is electrically connected to the controller 50. Accordingly, current supplied to the coil 340 can be controlled.

The second electromagnetic valve 35 includes the second valve body 35*b*, and the second solenoid 35*a* that generates an electromagnetic force for displacing the second valve body 35*b*. The second valve body 35*b* is capable of opening and closing the downstream passage of the purge valve 3. In FIGS. 2 and 3, the second electromagnetic valve 35 is controlled in an unseated state in which the second valve body 35*b* is separated from the second valve seat 33*c*1.

The second electromagnetic valve 35 is a normally closed valve that is controlled to be in a closed state in which the downstream passage is closed when no voltage is applied, and is controlled to be in an open state in which the downstream passage is open when voltage is applied. The controller 50 performs energization of the coil 350 of the second electromagnetic valve 35 by controlling a duty cycle, that is, a ratio of an energization turned-on period to a period of one cycle. The controller 50 controls the duty cycle in a range of 0% to 100%. According to the duty-cycle energization control, the flow rate of the evaporative fuel flowing through the downstream passage in the purge valve 3 changes in proportion to the duty cycle. The second electromagnetic valve 35 is controlled so that the duty cycle gradually increases from 0% to 100% when the mode of the first increase rate shown in the graph of FIG. 5 is being implemented. The second electromagnetic valve 35 is controlled so that the duty cycle gradually increases from a predetermined percentage: X % to 100% when the mode of the second increase rate shown in the graph of FIG. 5 is being implemented. X % is an arbitrary value set between 0% and 100%. X % may be set to a value that can ensure the continuity of the flow rate change from the first increase rate mode to the second increase rate mode as shown in FIG. 5.

The second solenoid 35*a* includes the coil 350, a bobbin 351, the movable core 352, the yoke 36, the annular plate 353*a*, the shaft 353*b* and a spring 354. The annular plate 353*a* is a component corresponding to the fixed core 343 in the first solenoid 34*a*. The central axis of the second solenoid 35*a* corresponds to the central axis of the second electromagnetic valve 35 and the central axis of the purge valve 3.

The movable core 352 is made of a material through which magnetism passes, for example, a magnetic material. The movable core 352 has a cup-shaped body with a bottom. The movable core 352 is provided so as to surround the spring 354, and the spring 354 is disposed inside the movable core 352. The spring 354 is provided between a shaft member 355 and the movable core 352. The shaft member 355 is fixed and press-fitted into the axial support 353. The spring 354 provides an urging force for moving the movable core 352 in a direction away from the shaft member 355. The spring 354 provides an urging force for moving the movable core 352 toward the second valve seat 33*c*1. The second valve body 35*b* is formed of an elastically deformable material such as rubber. The second valve body 35*b* is provided integrally with a downstream end of the movable core 352.

The axial support 353 slidably supports the movable core 352 that is being moved by the electromagnetic force in the axial direction against the urging force of the spring 354. The axial support 353 is provided integrally with the bobbin 351, the coil 350, the yoke 36, and the shaft member 355.

The axial support 353, the movable core 352, the second valve body 35*b*, the coil 350, and the yoke 36 are coaxial.

The bobbin 351 is formed of an insulating material and has a function of insulating the coil 350 from other parts. The axial support 353, the movable core 352, and the yoke 36 are made of a material that transmits magnetism. When the coil 340 is energized, a magnetic circuit indicated by dash lines around the coil 350 in FIGS. 2 and 3 is formed. This magnetic circuit generates an electromagnetic force that attracts the movable core 352 toward the shaft member 355. The electromagnetic force switches the second valve body 35*b* from the seated state to the unseated state. The magnetic circuit in the second electromagnetic valve 35 is formed by magnetism passing through the annular plate 353*a*, the movable core 352, the shaft 353*b*, the annular plate 362, and the cylindrical portion 361. The second valve body 35*b* is driven in accordance with a balance between the electromagnetic force generated upon energization of the coil 350 and the urging force of the spring 354, and is thereby switched between the seated state and the unseated state.

The housing is provided with a second connector having a terminal for energization of the coil 350 of the second electromagnetic valve 35. The terminal built in the second connector is a current-carrying terminal electrically connected to the coil 350. The second connector is connected to a power supply connector for power supply from a power source unit or a current controller. The second connector and the power supply connector are connected, and the terminal is electrically connected to the controller 50. Accordingly, current supplied to the coil 350 can be controlled.

Next, an operation of a purge valve controller will be described with reference to a flowchart of FIG. 4. The controller 50 executes a process according to the flowchart of FIG. 4. This flowchart starts when the evaporative fuel is made to flow to the engine 2. The second electromagnetic valve 35 is controlled by duty-cycle energization in which the duty cycle gradually increases from 0%.

When this flowchart starts, the controller 50 determines at step S100 whether it is in a state of learning concentration of evaporative fuel. When it is determined at step S100 that it is in the state of learning concentration, the controller 50 determines at step S120 whether the first electromagnetic valve 34 is energized. When it is determined at step S120 that the first electromagnetic valve 34 is in the energized state, the process returns to step S100, and the determination process of step S100 is performed. When it is determined at step S120 that the first electromagnetic valve 34 is not in the energized state, the first electromagnetic valve 34 is controlled to be in the energized state at step S125, and then the determination process of step S100 is performed.

When it is determined at step S100 that it is not in the state of learning concentration, the controller 50 determines at step S110 whether a noise generation condition is met. The noise generation condition is a preset condition under which noise is expected to be generated due to pressure fluctuation in the passage of the evaporative fuel or a fluttering sound of the ORVR valve 15. For example, the noise generation condition can be set to be met when a current vehicle speed is equal to or lower than a predetermined speed. In this case, the controller 50 acquires the current vehicle speed based on vehicle speed information detected by a vehicle speed sensor 61. The vehicle speed sensor 61 outputs the vehicle speed information to a vehicle ECU 60 that controls traveling of the vehicle and controls a cooling system necessary for traveling of the vehicle, and the vehicle speed information is output from the vehicle ECU 60 to the controller 50. The predetermined speed is preferably set based on an experimental result or an empirical rule, and is set to a vehicle speed at which the noise is drowned out by the traveling sound and is difficult for an occupant in the vehicle compartment to recognize. Accordingly, the noise generation condition is met when the current vehicle speed is lower than the predetermined speed. Therefore, it is possible to suppress noise that is likely to be generated when the vehicle speed is low and the traveling sound is low.

For example, when the vehicle is stopped, running at a low speed, or in an idling state of the engine 2, the controller 50 determines that the noise generation condition is met at step S110. When it is determined at step S110 that the noise generation condition is met, the process proceeds to step S120, and the determination process of step S120 is performed.

In the flow of returning from step S120 to step S100, and in the flow of returning to step S100 after executing step S125, the mode of the first increase rate in FIG. 5 is performed. In the mode of the first increase rate, since the rate of increase in flow rate of fluid is small, the accuracy of learning the concentration of the evaporative fuel can be improved. According to the mode of the first increase rate, the change in flow rate in the small flow rate range can be reduced as compared with the electromagnetic valve in which the flow rate increase rate is constant. Furthermore, in the mode of the first increase rate, a small flow rate can be implemented, so that pulsation can be reduced and an effect of suppressing noise can be obtained. Further, in the mode of the first increase rate, since the fluid flow rate is reduced, the fluttering of the ORVR valve 15 is reduced, and the effect of suppressing noise is obtained.

When it is determined at step S110 that the noise generation condition is not met, the controller 50 determines at step S130 whether the duty cycle of the second electromagnetic valve 35 has reached 100%. When it is determined at step S130 that the duty cycle has not reached 100%, the process returns to step S100, and the determination process of step S100 is performed. When it is determined at step S130 that the duty cycle has reached 100%, it is determined at step S140 whether the first electromagnetic valve 34 is in the energized state.

When it is determined at step S140 that the first electromagnetic valve 34 is not in the energized state, the process returns to step S100, and the determination process of step S100 is performed. When it is determined at step S140 that the first electromagnetic valve 34 is in the energized state, the controller 50 at step S150 controls the first electromagnetic valve 34 to be in a de-energized state. At step S160, the controller 50 reduces the duty cycle of second electromagnetic valve 35 to the predetermined value of X %, and returns to step S100. The controller 50 executes a control to gradually increase the duty cycle of the second electromagnetic valve 35 from the predetermined value toward 100%. The processes of steps S150 and S160 can smoothly shift the fluid flow rate controlled by the purge valve 3 from the mode of the first increase rate to the mode of the second increase rate as shown in FIG. 5.

In the flowchart, when the first electromagnetic valve 34 is not in the energized state, the mode of the second increase rate illustrated in FIG. 5 is performed. In the mode of the second increasing rate, enlargement of the flow rate is promoted in order to reduce a flow rate resistance of the upstream passage. According to the mode of the second increase rate, the change in flow rate in the large flow rate range can be increased as compared with the electromagnetic valve in which the flow rate increase rate is constant.

For this reason, the fluid flow rate can be rapidly increased in a state where noise is unlikely to be generated, so that an output demand from the engine 2 can be satisfied. According to the control in accordance with the flowchart of FIG. 4, it is possible to provide a flow control capable of suppressing noise caused by pulsation while achieving a large flow rate, as shown in FIG. 5.

Further, the controller 50 may determine at step S110 that the noise generation condition is met when a current rotation speed of the engine 2 is lower than a predetermined rotation speed. If such determination process is employed, the predetermined rotation speed is preferably set based on an experimental result or an empirical rule, and is set to a rotation speed at which the noise is drowned out by the engine sound and is difficult for the occupant to recognize. The noise generation condition is met when the current rotation speed of the engine 2 is lower than the predetermined rotation speed. Therefore, it is possible to reduce noise caused by pressure fluctuation and the like when the engine rotation speed is small and quiet.

Operational effects of the purge control valve device exemplified by the purge valve 3 of the first embodiment will be described. The purge control valve device includes the housing having the in-housing passage connecting the inflow port 31*a* and the outflow port 33*a*. The purge control valve device includes the first electromagnetic valve 34 that opens and closes the first internal passage to control the flow rate of evaporative fuel, and the second electromagnetic valve 35 that opens and closes the second internal passage to control the flow rate of evaporative fuel. The first internal passage and the second internal passage are arranged in series in the in-housing passage. The first electromagnetic valve 34 and the second electromagnetic valve 35 are controlled to operate individually. The first electromagnetic valve 34 switches between the seated state in which the first valve body 34*b* contacts the first valve seat 31*b*1 and the unseated state in which the first valve body 34*b* is separated from the first valve seat 31*b*1. The purge control valve device has the narrowed passage 31*c*1 in which the flow rate of the evaporative fuel is smaller in one of the seated state and the unseated state than another of the seated state and the unseated state.

Accordingly, it is possible to provide the purge control valve device including the narrowed passage 31*c*1 in which the evaporative fuel flowing through the first internal passage has a large flow rate in the other state and a small flow rate in the one state. The purge control valve device can be switched between the seated state and the unseated state such that the purge control valve device is set to the one state when it is desired to obtain a small flow rate characteristic or to suppress pulsation, and the purge control valve device is set to the other state when it is desired to secure a flow rate. As described above, both a small flow characteristic and a large flow characteristic can be obtained, and the purge control valve device capable of improving the flow characteristic can be obtained.

The purge control valve device includes the narrowed passage 31*c*1 such that the passage cross-sectional area of the first internal passage is smaller in one of the seated state and the unseated state of the first valve body than in the other state. Accordingly, it is possible to provide the purge control valve device including the narrowed passage 31*c*1 in which the passage cross-sectional area of the first internal passage is large in the other state and small in the one state. The purge control valve device can switch the passage cross-sectional area of the first internal passage such that the purge control valve device is set to the one state when it is desired to obtain a small flow rate characteristic or to suppress pulsation, and the purge control valve device is set to the other state when it is desired to secure a flow rate. In the purge control valve device, both a small flow characteristic and a large flow characteristic can be obtained, and the purge control valve device is capable of improving the flow characteristic.

In the purge control valve device, the first internal passage is disposed upstream of the second internal passage. According to this configuration, in the in-housing passage, an opening degree of the upstream passage can be varied, and the downstream passage can be opened and closed. Accordingly, it is possible to provide the purge control valve device in which pressure loss can be reduced and the configuration and control of the second electromagnetic valve 35 can be simplified.

The purge valve 3 includes a passage that functions as a narrowed passage in the unseated state, and an open passage which is larger in passage cross-sectional area than the narrowed passage and through which the evaporative fuel flows in the seated state. According to the purge valve 3, it is possible to provide the purge control valve device in which the evaporative fuel flowing through the narrowed passage in the unseated state has a small flow rate in the unseated state while the evaporative fuel flows through the open passage at a large flow rate in the seated state. The purge valve 3 can be switched between the seated state and the unseated state such that the purge valve 3 is set to the unseated state when it is desired to suppress pulsation, and the purge valve 3 is set to the seated state when it is desired to secure a flow rate. The purge valve 3 provides the purge control valve device that can achieve both pulsation suppression and flow rate securing.

When increasing a flow rate of evaporative fuel, the controller 50 individually controls the first electromagnetic valve 34 and the second electromagnetic valve 35 so as to separately perform the mode of the first increase rate and the mode of the second increase rate that is larger in increase rate than the first increase rate. The controller 50 controls the first electromagnetic valve 34 and the second electromagnetic valve 35 in the mode of the first increase rate so that the evaporative fuel flows through the narrowed passage. The controller 50 controls the first electromagnetic valve 34 and the second electromagnetic valve 35 in the mode of the second increase rate so that the evaporative fuel flows through the open passage which is larger in passage cross-sectional area than the narrowed passage. According to this control, it is possible to provide the purge control valve device that can achieve both pulsation suppression and flow rate securing by switching the mode of the first increase rate and the mode of the second increase rate at appropriate timing. The purge valve 3 can obtain a wide range of flow rate and can improve flow rate characteristics.

In the flow rate increase control in which the flow rate of the evaporative fuel flowing out from the outflow port 33*a* increases from zero, the controller 50 executes the mode of the first increase rate and then executes the mode of the second increase rate. According to this control, it is possible to provide the purge control valve device capable of suppressing pulsation of fluid and fluttering of the ORVR valve 15 from the start of purge and capable of exhibiting a large purge performance.

The controller 50 controls the first electromagnetic valve 34 by turning on and off its energization, and controls the second electromagnetic valve 35 by controlling the duty cycle of the applied voltage. The controller 50 controls the second electromagnetic valve so as to increase the duty cycle of the applied voltage in the mode of the first increase rate. The controller 50 reduces the duty cycle of the applied voltage once at the time of shifting from the mode of the first increase rate to the mode of the second increase rate. Then, the controller 50 controls the second electromagnetic valve 35 so as to increase the duty cycle in the mode of the second increase rate. Accordingly, at the time of shifting from the mode of the first increase rate to the mode of the second increase rate, it is possible to perform the purge control in which the flow rate of the evaporative fuel flowing out from the outflow port 33*a* does not largely change.

The controller 50 individually controls the first electromagnetic valve 34 and the second electromagnetic valve 35 so as to perform the mode of the first increase rate when learning the concentration of evaporative fuel. According to this control, the evaporative-fuel concentration learning can be performed with a small change in flow rate. Thus, it is possible to provide the purge control valve device that can achieve both pulsation suppression and flow rate securing, and that can further improve the accuracy of concentration learning.

The controller 50 individually controls the first electromagnetic valve 34 and the second electromagnetic valve 35 so as to perform the mode of the first increase rate when the noise generation condition which can be expected is met. According to this control, the mode of the first increase rate can be performed in a state where noise due to pulsation or fluttering of the ORVR valve 15 can occur. Accordingly, it is possible to provide the purge control valve device that can more efficiently suppress noise and realize a sufficient flow rate.

Second Embodiment

A second embodiment will be described with reference to FIGS. 6 to 8. A purge valve 103 according to the second embodiment is different from the first embodiment in first electromagnetic valve 134. The first electromagnetic valve 134 is a normally closed valve that controls small flow by narrowing an upstream passage when no voltage is applied, and controls large flow by fully opening the upstream passage when voltage is applied. A second electromagnetic valve 135 has the same configuration and the same operation as the second electromagnetic valve 35. Configurations, actions, and effects not specifically described in the second embodiment are the same as those in the first embodiment, and only points different from the first embodiment will be described below. The descriptions about the first electromagnetic valve 34 in the first embodiment can be used in the second embodiment by replacing the first electromagnetic valve 34 with the first electromagnetic valve 134. The descriptions about the second electromagnetic valve 35 in the first embodiment can be used in the second embodiment by replacing the second electromagnetic valve 35 with the second electromagnetic valve 135.

Next, configurations of the purge valve 103 will be described. The purge valve 103 includes the first electromagnetic valve 134 and the second electromagnetic valve 135 which are provided inside the housing. The first electromagnetic valve 134 and the second electromagnetic valve 135 are arranged inside the purge valve 103 in a direction from an upstream side to a downstream side. The first electromagnetic valve 134 and the second electromagnetic valve 135 are arranged in a direction of displacement of a valve body of the purge valve 103 or in an axial direction of the valve body. The first electromagnetic valve 134 is located upstream of the second electromagnetic valve 135. The first electromagnetic valve 134 adjusts a passage cross-sectional area of the upstream passage in the purge valve 103. The second electromagnetic valve 135 adjusts a passage cross-sectional area of a downstream passage in the purge valve 103.

A first valve body 34*b* contacts a first valve seat 31*b*1 in a seated state of the first electromagnetic valve 134. The flow path narrowing wall 31*c* of the first embodiment is not provided on a flange 31*b* of an inflow housing 131. Therefore, the purge valve 103 does not include the narrowed passage 31*c*1 of the first embodiment.

A plate 134*b*1 is provided integrally with an upstream end of a movable core 342. The upstream surface of the plate 134*b*1 faces the first valve seat 31*b*1 in the axial direction. The plate 134*b*1 is provided with multiple or one through-hole 134*b*2. As shown in FIG. 6, when the first valve body 34*b* is in the seated state, the through-hole 134*b*2 forms a flow passage through which the fluid can flow. As shown in FIG. 7, when the first valve body 34*b* is in an unseated state, the through-hole 134*b*2 forms a passage through which the fluid does not flow. When fluid flows at a first increase rate shown in FIG. 5, the through-hole 134*b*2 corresponds to the upstream passage of the purge valve 103 through which the fluid flows.

Figure 7:
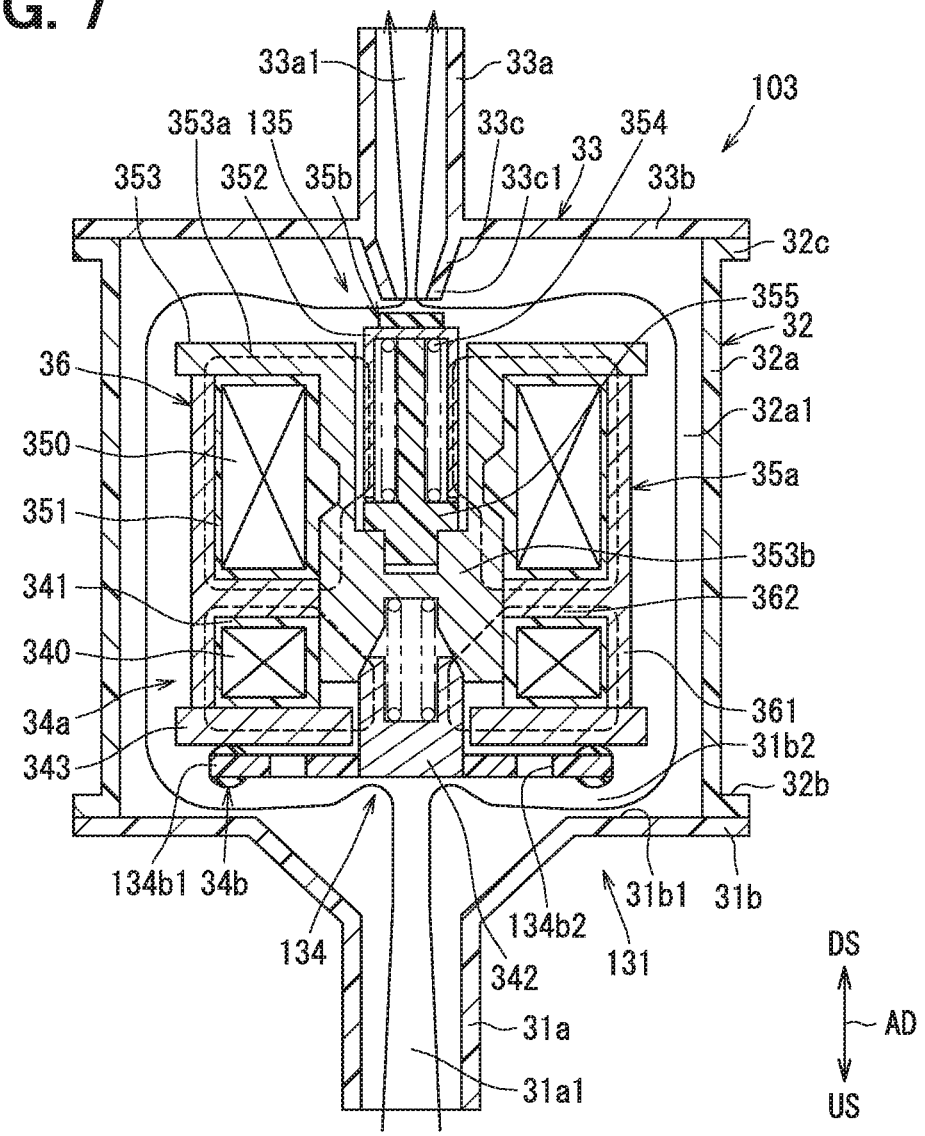
FIG. 7 is a sectional view illustrating an operation of the purge control valve device at a second increase rate, according to at least one embodiment.
Figure 8:
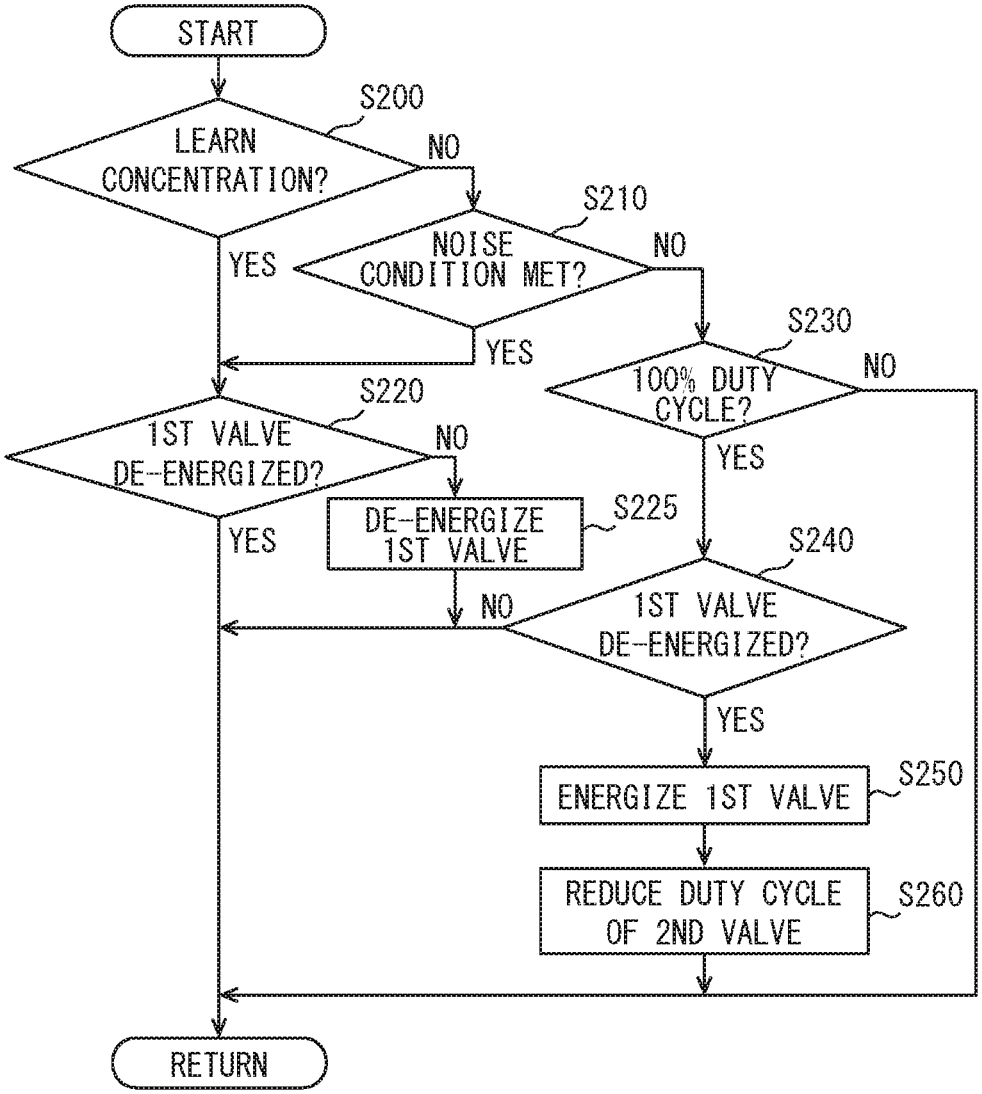
FIG. 8 is a flowchart illustrating a control of the purge control valve device.

The through-hole 134*b*2 forms a passage smaller in passage cross-sectional area than a passage 31*b*2 formed between the first valve body 34*b* and the first valve seat 31*b*1 in the unseated state shown in FIG. 7. When the first valve body 34*b* is in the seated state, the through-hole 134*b*2 forms a narrowed passage through which the fluid flows. The purge valve 103 includes the narrowed passage that reduces a passage cross-sectional area of a first internal passage to be smaller than that in the unseated state of the first valve body 34*b*. The through-hole 134*b*2 is configured such that fluid does not flow therethrough in the unseated state of the first valve body 34*b*. When fluid flows at a first increase rate shown in FIG. 5, the through-hole 134*b*2 corresponds to the upstream passage of the purge valve 103 through which the fluid flows. The through-hole 134*b*2 functions as a narrowed passage through which the evaporative fuel flows in the mode of the first increase rate. The passage 31*b*2 forms an open passage through which the evaporative fuel flows when the first valve body 34*b* is in the unseated state. The purge valve 103 includes the open passage that increases the passage cross-sectional area of the first internal passage to be larger than that in the seated state of the first valve body 34*b*. The passage 31*b*2 functions as an open passage through which the evaporative fuel flows in the mode of the second increase rate.

The first electromagnetic valve 134 and the second electromagnetic valve 135 each include a solenoid and a valve body, and individually form a magnetic circuit. The first electromagnetic valve 134 and the second electromagnetic valve 135 are configured such that energization of their coils are individually controlled by the controller 50.

The first electromagnetic valve 134 includes the first valve body 34*b*, and a first solenoid 34*a* that generates an electromagnetic force for displacing the first valve body 34*b*. The first valve body 34*b* is capable of adjusting a flow path resistance in the upstream passage in the purge valve 103. The first electromagnetic valve 134 shown in FIG. 6 is controlled in the seated state in which the first valve body 34*b* is in contact with the first valve seat 31*b*1. In the seated state of the first valve body 34*b*, a flow rate of fluid increases at a small increase rate that is the first increase rate shown in the graph of FIG. 5. The first electromagnetic valve 134 shown in FIG. 7 is controlled in the unseated state in which the first valve body 34*b* is separated from the first valve seat 31*b*1. In the unseated state of the first valve body 34*b*, the flow rate of fluid increases at the second increase rate that is larger than the first increase rate as shown in the graph of FIG. 5. The first electromagnetic valve 134 is controlled in the unseated state when voltage is applied, and is controlled in the seated state when no voltage is applied.

Figure 6:
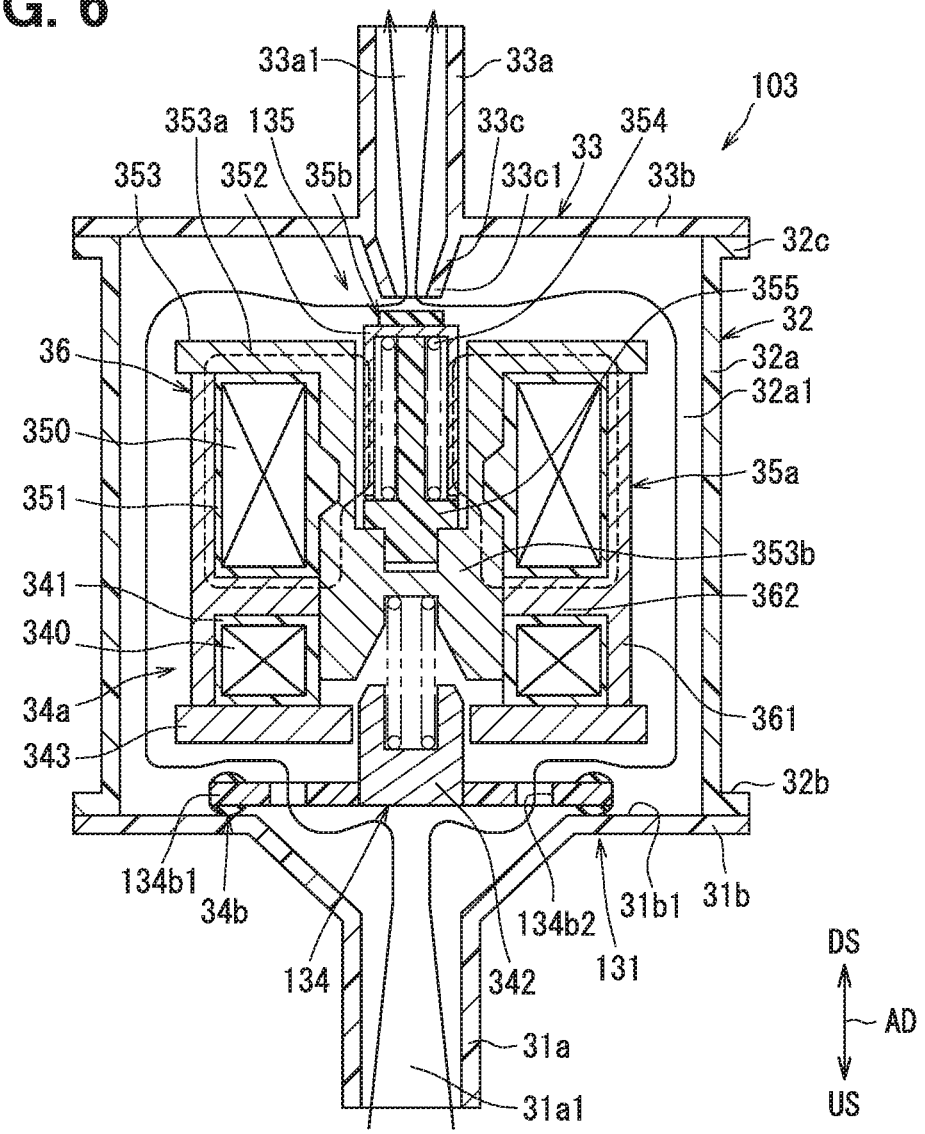
FIG. 6 is a sectional view illustrating an operation of the purge control valve device at a first increase rate, according to at least one embodiment.

In FIGS. 6 and 7, the second electromagnetic valve 135 is controlled in an unseated state in which the second valve body 35*b* is separated from the second valve seat 33*c*1. The second electromagnetic valve 135 is a normally closed valve that is controlled to be in a closed state in which the downstream passage is closed when no voltage is applied, and is controlled to be in an open state in which the downstream passage is open when voltage is applied. The controller 50 controls a duty cycle to energize the coil 350 of the second electromagnetic valve 135.

Next, an operation of a purge valve controller will be described with reference to a flowchart of FIG. 8. The controller 50 executes a process according to the flowchart of FIG. 8. The second electromagnetic valve 135 is controlled by duty-cycle energization in which the duty cycle gradually increases from 0%. S200, S210, S230, and S260 shown in FIG. 8 are the same processes as S100, S110, S130, and S160 shown in FIG. 4, and their descriptions of the first embodiment is incorporated herein.

When it is determined at step S200 that it is in the state of learning concentration, the controller 50 determines at step S220 whether the first electromagnetic valve 134 is not energized, i.e., in a de-energized state. When it is determined at step S220 that the first electromagnetic valve 134 is in the de-energized state, the process returns to step S200, and the determination process of step S200 is performed. When it is determined at step S220 that the first electromagnetic valve 134 is in the energized state, the first electromagnetic valve 134 is controlled to be in the de-energized state at step S225, and then the determination process of step S200 is performed.

When it is determined at step S200 that it is not in the state of learning concentration, and a noise generation condition is determined to be met at step S210, the determination process of S220 is performed. In the flow of returning from step S220 to step S200, and in the flow of returning to step S200 after executing step S225, the mode of the first increase rate in FIG. 5 is performed. In the mode of the first increase rate, since the rate of increase in flow rate of fluid is small, the accuracy of learning the concentration of the evaporative fuel can be improved. In the mode of the first increase rate, a flow rate of fluid can be reduced, so that pulsation can be reduced and an effect of suppressing noise can be obtained. In the mode of the first increase rate, since the fluid flow rate is reduced, the fluttering of the ORVR valve 15 is reduced, and the effect of suppressing noise is obtained.

When it is determined at step S230 that the duty cycle has reached 100%, it is determined at step S240 whether the first electromagnetic valve 134 is in the de-energized state. When it is determined at step S240 that the first electromagnetic valve 134 is not in the de-energized state, the process returns to step S200, and the determination process of step S200 is performed. When it is determined at step S240 that the first electromagnetic valve 134 is in the de-energized state, the controller 50 at step S250 controls the first electromagnetic valve 134 to be in the energized state. At step S260, the controller 50 reduces the duty cycle of second electromagnetic valve 135 to the predetermined value of X %, and returns to step S200. The controller 50 executes a control to gradually increase the duty cycle of the second electromagnetic valve 135 from the predetermined value toward 100%. The processes of steps S250 and S260 can smoothly shift the fluid flow rate controlled by the purge valve 103 from the mode of the first increase rate to the mode of the second increase rate as shown in FIG. 5.

In the flowchart, when the first electromagnetic valve 134 is not in the de-energized state, the mode of the second increase rate illustrated in FIG. 5 is performed. In the mode of the second increase rate, for promoting large capacity control, a change in flow rate within a large flow rate range can be increased as compared with the electromagnetic valve in which the flow rate increase rate is constant. According to the control in accordance with the flowchart of FIG. 8, it is possible to provide a flow control capable of suppressing noise caused by pulsation while achieving a large flow rate, as shown in FIG. 5.

The device of the second embodiment includes a passage that functions as a narrowed passage in the seated state, and an open passage which is larger in passage cross-sectional area than the narrowed passage and through which the evaporative fuel flows in the unseated state. According to the purge valve 103, it is possible to provide the purge control valve device in which the evaporative fuel flowing through the narrowed passage in the seated state has a small flow rate in the unseated state while the evaporative fuel flows through the open passage at a large flow rate in the unseated state. The purge valve 103 can be switched between the seated state and the unseated state such that the purge valve 3 is set to the seated state when it is desired to suppress pulsation, and the purge valve 3 is set to the unseated state when it is desired to secure a flow rate. The purge valve 103 provides the purge control valve device that can achieve improvements of small flow characteristic, pulsation suppression and securing of large flow rate. The purge valve 103 can obtain a wide range of flow rate and can improve flow rate characteristics.

Third Embodiment

A purge valve 203 of a third embodiment will be described with reference to FIGS. 9 to 10. The purge valve 203 is different from the first embodiment in that the purge valve 203 includes a second valve regulator 345 that moves in an axial direction together with a first valve body 34*b*. The second valve regulator 345 is coupled to a movable core 342 of a first electromagnetic valve 234, and is displaced in the axial direction together with the movable core 342. The second valve regulator 345 can limit a movable distance of a movable core 352 of a second electromagnetic valve 235 in a direction away from a seat. The second valve regulator 345 moves integrally with the first valve body 34*b* in response to an electromagnetic force, and has a function to change a displaceable range of the second valve body 35*b*. Further, the second valve regulator 345 and the movable core 342 may be configured as a single component.

The first electromagnetic valve 234 is a normally open valve that controls small flow by narrowing the upstream passage when voltage is applied, and controls large flow by fully opening the upstream passage when no voltage is applied. The second electromagnetic valve 235 is a normally closed valve, similar to the second electromagnetic valve 35. Configurations, actions, and effects not specifically described in the third embodiment are the same as those in the first embodiment, and only points different from the first embodiment will be described below.

Next, configurations of the purge valve 203 will be described. The purge valve 203 includes the first electromagnetic valve 234 and the second electromagnetic valve 235 which are provided inside the housing. The first electromagnetic valve 234 and the second electromagnetic valve 235 are arranged inside the purge valve 203 in a direction from an upstream side to a downstream side. The first electromagnetic valve 234 and the second electromagnetic valve 235 are arranged in a direction of displacement of a valve body of the purge valve 203 or in an axial direction of the valve body. The first electromagnetic valve 234 is located upstream of the second electromagnetic valve 235. The first electromagnetic valve 234 adjusts a passage cross-sectional area of the upstream passage in the purge valve 203. The second electromagnetic valve 235 adjusts a passage cross-sectional area of a downstream passage in the purge valve 203.

The first electromagnetic valve 234 and the second electromagnetic valve 235 each include a solenoid and a valve body, and individually form a magnetic circuit. The first electromagnetic valve 234 and the second electromagnetic valve 235 are configured such that energization of their coils are individually controlled by the controller 50. The first electromagnetic valve 234 includes the first valve body 34*b*, and a first solenoid 234*a* that generates an electromagnetic force for displacing the first valve body 34*b*. The first valve body 34*b* is capable of adjusting a flow path resistance in the upstream passage in the purge valve 203.

Figure 9:
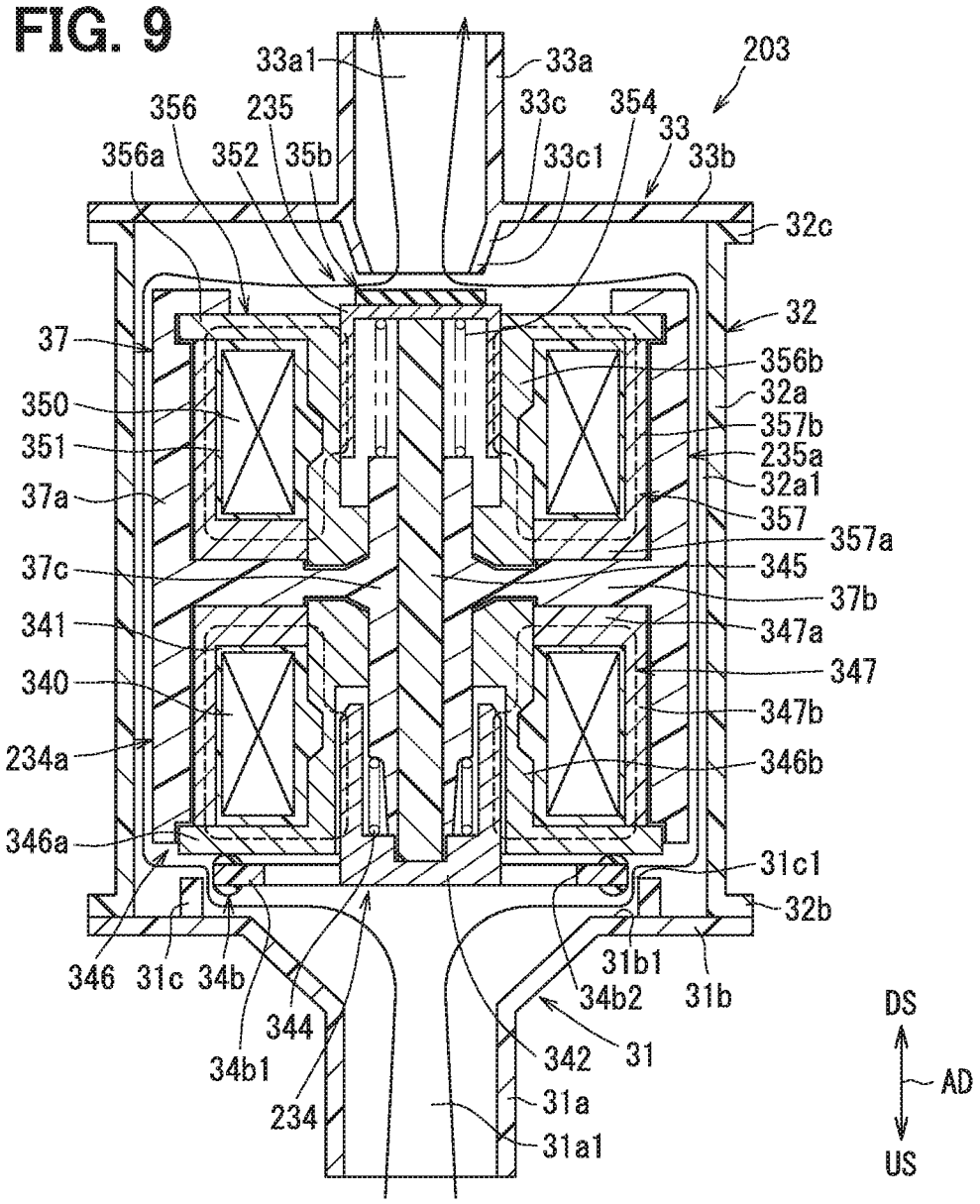
FIG. 9 is a sectional view illustrating an operation of the purge control valve device at a first increase rate, according to at least one embodiment.

The first electromagnetic valve 234 shown in FIG. 9 is controlled in the unseated state in which the first valve body 34*b* is separated from the first valve seat 31*b*1. The first valve body 34*b* is controlled to be in the unseated state in order to implement a mode of a first increase rate. The state shown in FIG. 9 shows a state in which the mode of the first increase rate shown in FIG. 5 starts. The first electromagnetic valve 234 shown in FIG. 10 is controlled in the seated state in which the first valve body 34*b* is in contact with the first valve seat 31*b*1. The first valve body 34*b* is controlled to be in the seated state in order to implement a mode of a second increase rate. The state shown in FIG. 10 shows a state in which the mode of the second increase rate shown in FIG. 5 starts. The first electromagnetic valve 234 is controlled in the unseated state when voltage is applied, and is controlled in the seated state when no voltage is applied.

Figure 10:
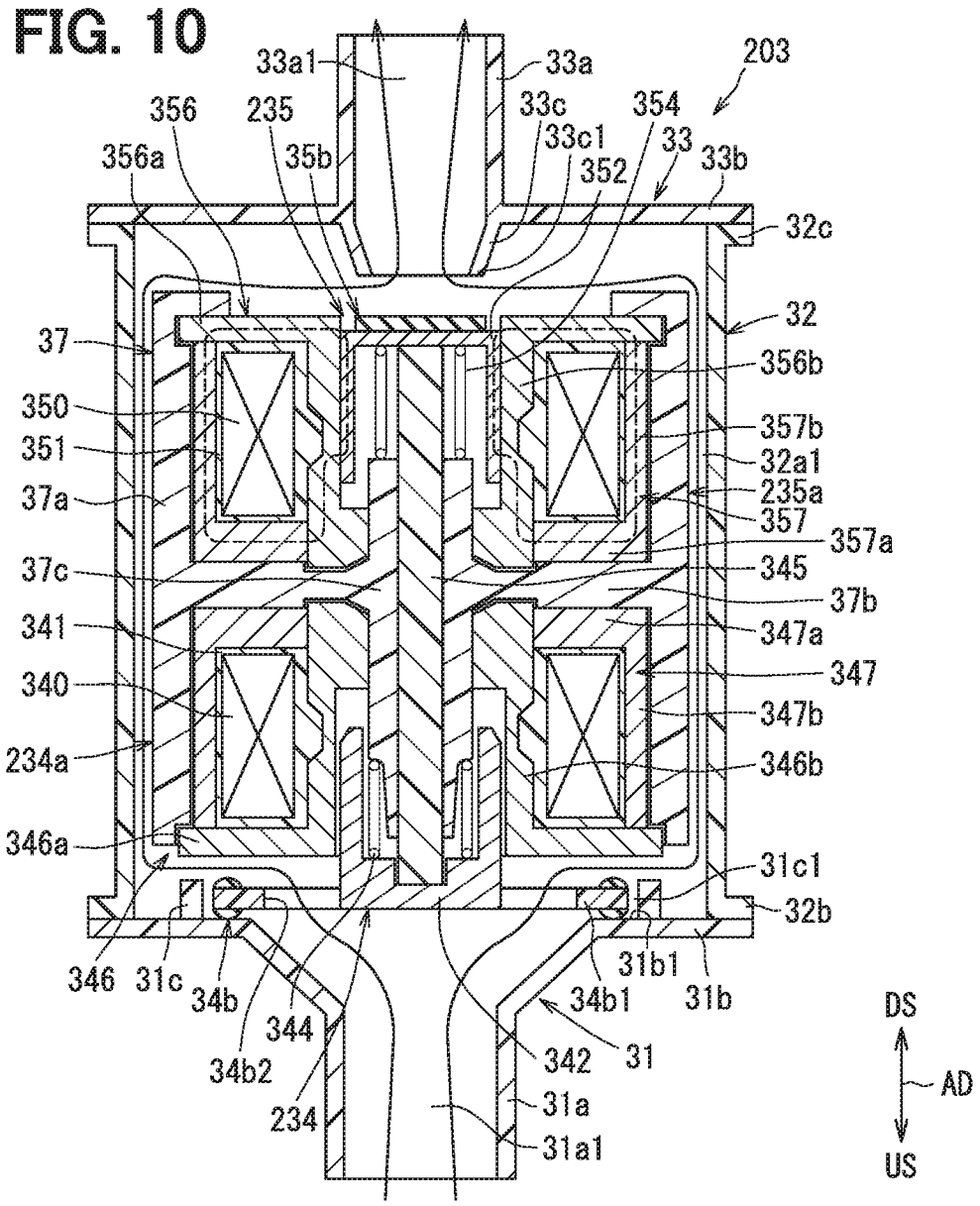
FIG. 10 is a sectional view illustrating an operation of the purge control valve device at a second increase rate, according to at least one embodiment.

In the unseated state of the first valve body 34*b*, the second valve regulator 345 together with the movable core 342 is located closer to a second valve seat 33*c*1 than in the seated state shown in FIG. 10. Thus, the movable core 352 is located closer to the second valve seat 33*c*1 in the unseated state of the first valve body 34*b* than in the seated state shown in FIG. 10. The displaceable range in which the second valve body 35*b* can be displaced by action of electromagnetic force is smaller in the unseated state of the first valve body 34*b* than in the seated state of the first valve body 34*b*. In the unseated state of the first valve body 34*b* where the mode of the first increase rate is performed, a stroke amount in which the second valve body 35*b* is displaceable to be seated is shorter than in the seated state in which the mode of the second increase rate is performed. The passage cross-sectional area of a second internal passage in the purge valve 203 is larger in FIG. 10 than in FIG. 9. The second valve regulator 345 brings the second valve body 35*b* closer to the second valve seat 33*c*1 in one state where the narrowed passage 31*c*1 is formed than in the other state.

In FIGS. 9 and 10, the second electromagnetic valve 235 is controlled in the unseated state in which the second valve body 35*b* is separated from the second valve seat 33*c*1. The second electromagnetic valve 235 is a normally closed valve that is controlled to be in a closed state in which the downstream passage is closed when no voltage is applied, and is controlled to be in an open state in which the downstream passage is open when voltage is applied. The controller 50 controls a duty cycle to energize the coil 350 of the second electromagnetic valve 235.

The first solenoid 234*a* includes a coil 340, a bobbin 341, a movable core 342, the fixed core 346, a yoke 347, a shaft 37*c* and a spring 344. The central axis of the first solenoid 234*a* corresponds to the central axis of the first electromagnetic valve 234 and the central axis of the purge valve 203. The central axis of the first solenoid 234*a* is also the central axis of the second valve regulator 345. The shaft 37*c* supports the second valve regulator 345 to be slidable in the axial direction. The shaft 37*c* has a cylindrical body. The shaft 37*c* supports the second valve regulator 345 to be slidable in the axial direction such that an inner peripheral surface of the shaft 37*c* slides on an outer peripheral surface of the second valve regulator 345. The second valve regulator 345 is formed of, for example, metal, resin, or the like.

The shaft 37*c* is a part of an axial support 37. The axial support 37 includes the shaft 37*c*, an outer cylindrical portion 37*a* having a larger outer diameter than the shaft 37*c*, and an annular plate 37*b* connecting the shaft 37*c* and the outer cylindrical portion 37*a*. The outer cylindrical portion 37*a* coaxially supports the first solenoid 234*a* and a second solenoid 235*a*. The axial support 37 is fixed to, for example, a housing in the purge valve 203. An inner peripheral surface of an intermediate housing 32 and an outer peripheral surface of the outer cylindrical portion 37*a* define an intermediate passage 32*a*1 therebetween.

The spring 344 is provided between the shaft 37*c* and the movable core 342. The spring 344 provides an urging force for moving the movable core 342 in a direction away from the shaft 37*c*. The axial support 37 is formed of, for example, metal, resin, or the like.

The fixed core 346 slidably supports the movable core 342 that is being moved by the electromagnetic force in the axial direction against the urging force of the spring 344. The fixed core 346 includes a cylindrical portion 346*b* having opposite open ends in the axial direction, and an annular plate 346*a* having a flange shape and provided at an upstream end of the cylindrical portion 346*b*. An inner peripheral surface of the cylindrical portion 346*b* slidably supports the movable core 342, The coil 340 is wound around an outer peripheral surface of the cylindrical portion 346*b* via the bobbin 341. The annular plate 346*a* is engaged with the outer cylindrical portion 37*a* of the axial support 37. The fixed core 346 is provided integrally with the bobbin 341, the coil 340, the yoke 347, and the axial support 37. The yoke 347 includes a cylindrical portion 347*b* and an annular plate 347*a* extending from an inner peripheral surface of a downstream end of the cylindrical portion 347*b* toward the center. The fixed core 346, the movable core 342, the first valve body 34*b*, the coil 340, and the yoke 347 are coaxial.

The fixed core 346, the movable core 342, and the yoke 347 are made of a material that transmits magnetism. When the coil 340 is energized, a magnetic circuit indicated by dash lines around the coil 340 in FIG. 9 is formed. This magnetic circuit generates an electromagnetic force that attracts the movable core 342 toward the shaft 37*c*. The electromagnetic force switches the first valve body 34*b* of the first electromagnetic valve 234 from the seated state to the unseated state. The magnetic circuit in the first electromagnetic valve 234 is formed by magnetism passing through the annular plate 346*a*, the movable core 342, the cylindrical portion 346*b*, the annular plate 347*a*, and the cylindrical portion 347*b*. The first valve body 34*b*, the movable core 342, and the second valve regulator 345 are driven in the axial direction according to a balance between the electromagnetic force generated at the time of energization and the urging force of the spring 344.

The second electromagnetic valve 235 includes the second valve body 35*b*, and a second solenoid 235*a* that generates an electromagnetic force for displacing the second valve body 35*b*. The controller 50 controls a duty cycle to energize the coil 350 of the second electromagnetic valve 235. The second electromagnetic valve 235 is controlled so that the duty cycle gradually increases from 0% to 100% when the mode of the first increase rate is being implemented. The second electromagnetic valve 235 is controlled so that the duty cycle gradually increases from a predetermined percentage X % to 100% when the mode of the second increase rate is being implemented.

The second solenoid 235*a* includes the coil 350, a bobbin 351, the movable core 352, a fixed core 356, a yoke 357, the shaft 37*c* and a spring 354. The central axis of the second solenoid 235*a* corresponds to the central axis of the second electromagnetic valve 235 and the central axis of the purge valve 203. The central axis of the second solenoid 235*a* is also the central axis of the second valve regulator 345. The spring 354 is provided between the shaft 37*c* and the movable core 352. The spring 354 provides an urging force for moving the movable core 352 in a direction away from the shaft 37*c*.

The fixed core 356 slidably supports the movable core 352 that is being moved by the electromagnetic force in the axial direction against the urging force of the spring 354. The fixed core 356 includes a cylindrical portion 356*b* having opposite open ends in the axial direction, and an annular plate 356*a* having a flange shape and provided at an upstream end of the cylindrical portion 356*b*. An inner peripheral surface of the cylindrical portion 356*b* slidably supports the movable core 352. The coil 350 is wound around an outer peripheral surface of the cylindrical portion 356*b* via the bobbin 351. The annular plate 356*a* is engaged with the outer cylindrical portion 37*a* of the axial support 37. The fixed core 356 is provided integrally with the bobbin 351, the coil 350, the yoke 357, and the axial support 37. The yoke 357 includes a cylindrical portion 357*b* and an annular plate 357*a* extending from an inner peripheral surface of a downstream end of the cylindrical portion 357*b* toward the center. The fixed core 356, the movable core 352, the second valve body 35*b*, the coil 350, and the yoke 357 are coaxial.

The fixed core 356, the movable core 352, and the yoke 357 are made of a material that transmits magnetism. When the coil 340 is energized, a magnetic circuit indicated by dash lines around the coil 350 in FIGS. 9 and 10 is formed. This magnetic circuit generates an electromagnetic force that attracts the movable core 352 toward the shaft 37*c*. The electromagnetic force switches the second valve body 35*b* of the second electromagnetic valve 235 from the seated state to the unseated state. The magnetic circuit in the second electromagnetic valve 235 is formed by magnetism passing through the annular plate 356*a*, the movable core 352, the cylindrical portion 356*b*, the annular plate 357*a*, and the cylindrical portion 357*b*. The second valve body 35*b* and the movable core 352 are driven in the axial direction according to a balance between the electromagnetic force generated at the time of energization and the urging force of the spring 354.

Figure 4:
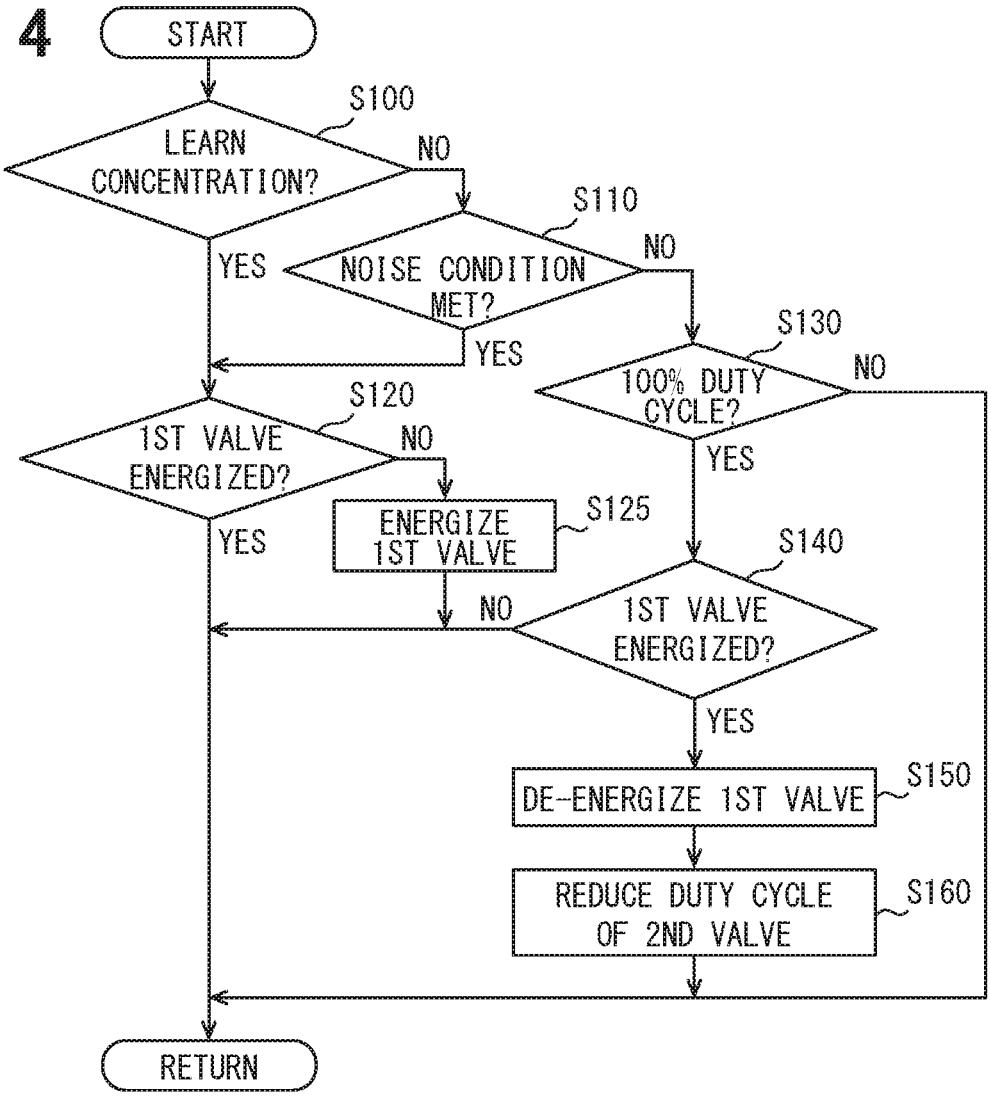
FIG. 4 is a flowchart illustrating a control of the purge control valve device.

The controller 50 controls the purge valve 203 by executing the processing according to the flowchart of FIG. 4, similar to the first embodiment. The descriptions of the processing according to the flowchart of FIG. 4 in the first embodiment are incorporated herein by replacing the first electromagnetic valve 34 and the second electromagnetic valve 35 with the first electromagnetic valve 234 and the second electromagnetic valve 235.

Operational effects of the purge control valve device exemplified by the purge valve 203 of the third embodiment will be described. The purge valve 203 includes a passage that functions as a narrowed passage in the unseated state, and an open passage which is larger in passage cross-sectional area than the narrowed passage and through which the evaporative fuel flows in the seated state. According to the purge valve 203, it is possible to provide the purge control valve device in which the evaporative fuel flowing through the narrowed passage in the unseated state has a small flow rate in the unseated state while the evaporative fuel flows through the open passage at a large flow rate in the seated state. The purge valve 203 can be switched between the seated state and the unseated state such that the purge control valve device is set to the one state when it is desired to obtain a small flow rate characteristic or to suppress pulsation, and the purge control valve device is set to the other state when it is desired to secure a flow rate. As described above, the purge valve 203 can obtain both a small flow characteristic and a large flow characteristic, and the purge valve 203 provides a purge control valve device capable of improving the flow characteristic can be obtained.

The purge valve 203 includes the second valve regulator 345 that changes the axial distance between the second valve body 35*b* and the second valve seat 33*c*1 according to the seated state and the unseated state of the first valve body 34*b*. According to this configuration, the stroke amount in which the second valve body 35*b* can move to be seated can be smaller in the mode of first increase rate than in the mode of the second increase rate. Accordingly, a precise flow rate change and a smooth flow rate change can be realized in the mode of the first increase rate. The purge valve 203 contributes to smooth shifting of the fluid flow rate from the mode of the first increase rate to the mode of the second increase rate, and contributes to increasing linearity of the flow rate change. The effects can contribute reducing the pressure fluctuation range in the flow path leading to the canister 13 and reducing the fluttering sound of the ORVR valve 15.

Fourth Embodiment

Figure 11:
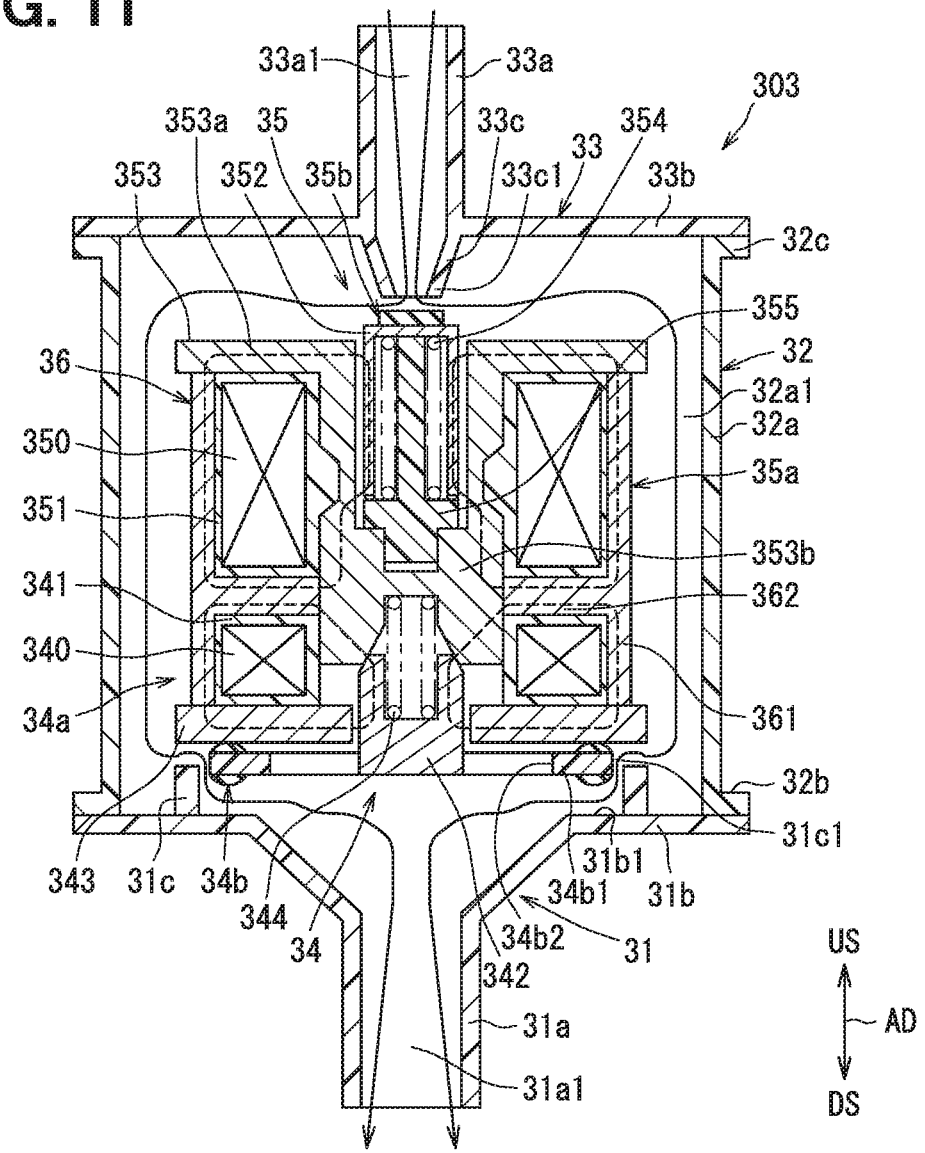
FIG. 11 is a sectional view illustrating an operation of the purge control valve device at a first increase rate, according to at least one embodiment.

A purge valve 303 of a fourth embodiment will be described with reference to FIG. 11. The purge valve 303 is different from the purge valve 3 of the first embodiment in that a flow direction of fluid inside the apparatus is opposite.

With respect to the purge valve 303, configurations, actions, and effects not specifically described in the fourth embodiment are the same as those in the first embodiment, and only points different from the first embodiment will be described below. In the purge valve 303, the second electromagnetic valve 35 and the first electromagnetic valve 34 are arranged inside the apparatus in a direction from an upstream side to a downstream side. In the purge valve 303, the outflow port 33*a* of the first embodiment functions as an inflow port, and the inflow port 31*a* of the first embodiment functions as an outflow port. In the fourth embodiment, a second internal passage is an upstream passage in the in-housing passage, and a first internal passage is a downstream passage in the in-housing passage.

Fifth Embodiment

Figure 12:
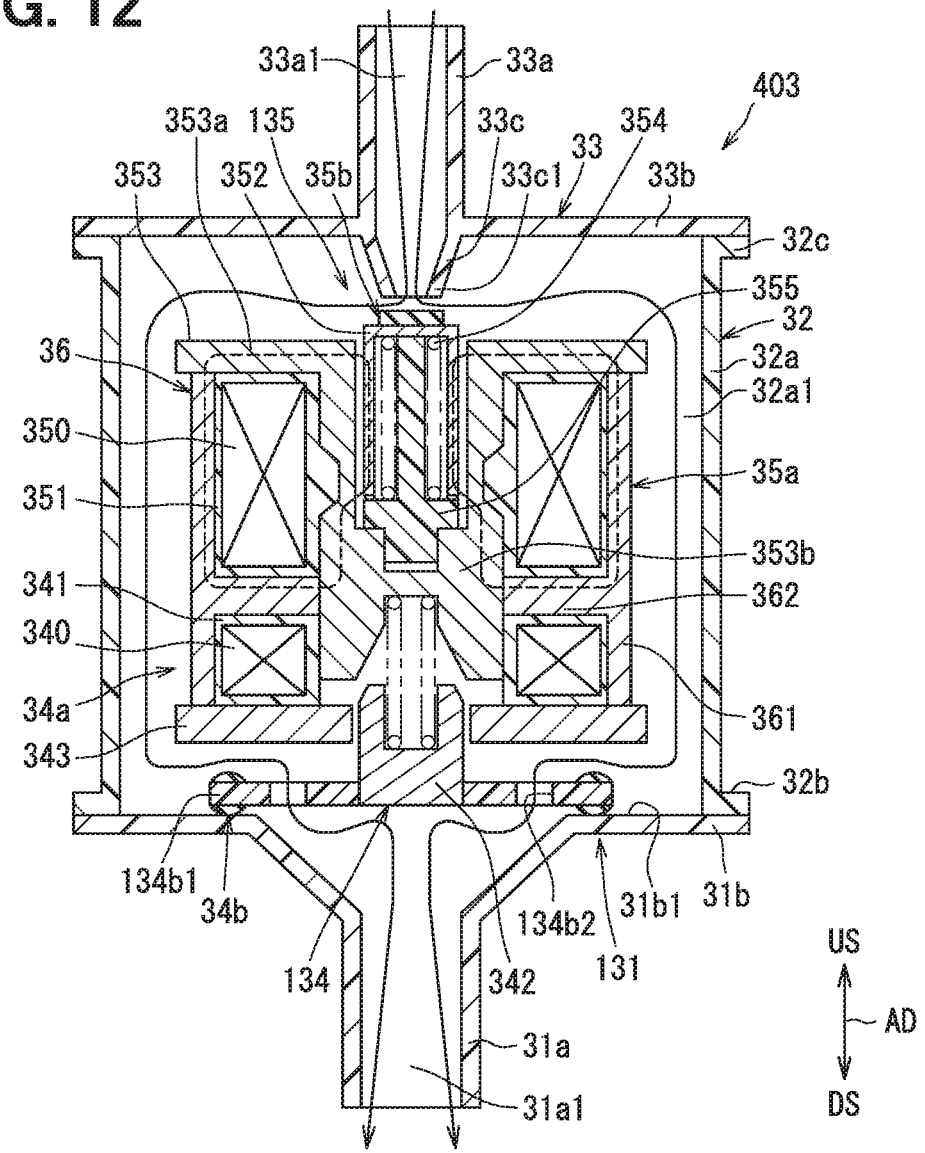
FIG. 12 is a sectional view illustrating an operation of the purge control valve device at a first increase rate, according to at least one embodiment.

A purge valve 403 of a fifth embodiment will be described with reference to FIG. 12. The purge valve 403 is different from the purge valve 103 of the second embodiment in that a flow direction of fluid inside the apparatus is opposite.

With respect to the purge valve 403, configurations, actions, and effects not specifically described in the fifth embodiment are the same as those in the second embodiment, and only points different from the first embodiment will be described below. In the purge valve 403, the second electromagnetic valve 135 and the first electromagnetic valve 134 are arranged inside the apparatus in a direction from an upstream side to a downstream side. In the purge valve 403, the outflow port 33*a* of the second embodiment functions as an inflow port, and the inflow port 31*a* of the second embodiment functions as an outflow port. In the fifth embodiment, a second internal passage is an upstream passage in the in-housing passage, and a first internal passage is a downstream passage in the in-housing passage.

Sixth Embodiment

Figure 13:
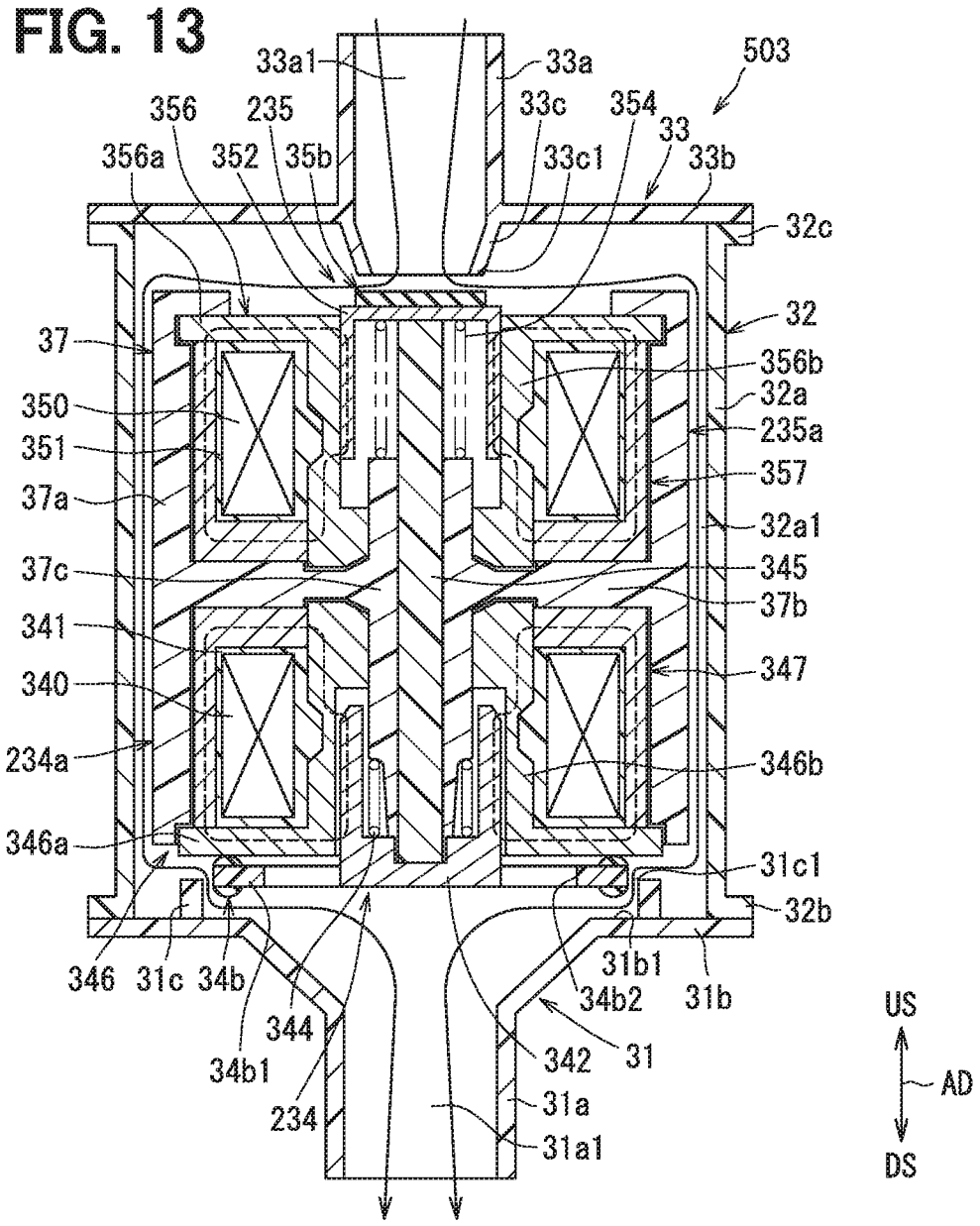
FIG. 13 is a sectional view illustrating an operation of the purge control valve device at a first increase rate, according to at least one embodiment.

A purge valve 503 of a sixth embodiment will be described with reference to FIG. 13. The purge valve 503 is different from the purge valve 203 of the third embodiment in that a flow direction of fluid inside the apparatus is opposite.

With respect to the purge valve 503, configurations, actions, and effects not specifically described in the sixth embodiment are the same as those in the third embodiment, and only points different from the first embodiment will be described below. In the purge valve 503, the second electromagnetic valve 235 and the first electromagnetic valve 234 are arranged inside the apparatus in a direction from an upstream side to a downstream side. In the purge valve 503, the outflow port 33*a* of the third embodiment functions as an inflow port, and the inflow port 31*a* of the third embodiment functions as an outflow port. In the sixth embodiment, a second internal passage is an upstream passage in the in-housing passage, and a first internal passage is a downstream passage in the in-housing passage.

OTHER EMBODIMENTS

The disclosure in the present specification is not limited to the illustrated embodiments. The disclosure encompasses the illustrated embodiments and variations based on the embodiments by those skilled in the art. For example, the disclosure is not limited to the combinations of components and elements shown in the embodiments, and can be implemented with various modifications. The disclosure may be implemented in various combinations. The disclosure may have additional portions that may be added to the embodiments. The disclosure encompasses the omission of parts and elements of the embodiments. The disclosure encompasses the replacement or combination of components, elements between one embodiment and another. The disclosed technical scope is not limited to the description of the embodiment. Technical scopes disclosed are indicated by descriptions in the claims and should be understood to include all modifications within the meaning and scope equivalent to the descriptions in the claims.

The purge control valve device in the specification includes a first electromagnetic valve that controls flow on the upstream side and a second electromagnetic valve that controls flow on the downstream side in a passage connecting the inflow port and the outflow port. The purge control valve device is not limited to the configuration having one inflow port and one outflow port. The purge control valve device may have a configuration including multiple inflow ports and multiple outflow ports. The purge control valve device may have a configuration having one inflow port and multiple outflow ports. The purge control valve device may have a configuration having multiple inflow ports and one outflow port.

As described in the fourth to sixth embodiments, the purge control valve device in the specification is configured such that the first electromagnetic valve forming the narrowed passage is located downstream of the second electromagnetic valve. In this configuration, the first internal passage connected in series with the second internal passage is arranged downstream of the second internal passage.

While the present disclosure has been described with reference to various exemplary embodiments thereof, it is to be understood that the disclosure is not limited to the disclosed embodiments and constructions. To the contrary, the disclosure is intended to cover various modifications and equivalent arrangements. In addition, while the various elements of the disclosure are shown in various combinations and configurations, which are exemplary, other various combinations and configurations, including more, less or only a single element, are also within the spirit of the disclosure.

What is claimed is:

1. A purge control valve device comprising:

an inflow port into which the evaporative fuel flowing out of a canister flows;

an outlet port through which the evaporative fuel flows out toward an engine;

a housing having an in-housing passage connecting the inflow port and the outflow port;

a first electromagnetic valve provided inside the housing and having a first valve body opening and closing a first internal passage included in the in-housing passage to control a flow rate of the evaporative fuel; and a second electromagnetic valve provided inside the housing and having a second valve body opening and closing a second internal passage included in the in-housing passage to control a flow rate of the evaporative fuel, wherein the first internal passage and the second internal passage are arranged in series in the in-housing passage, the first electromagnetic valve and the second electromagnetic valve are controlled to operate individually, and the first electromagnetic valve is switched between a seated state in which the first valve body contacts a first valve seat and an unseated state in which the first valve body is separated from the first valve seat, the purge control valve device further comprising a narrowed passage in which a flow rate of the evaporative fuel is smaller in one of the seated state and the unseated state than in another of the seated state and the unseated state, and a valve regulator that moves together with the first valve body in response to an electromagnetic force and regulates a displaceable range of the second valve body, wherein the valve regulator brings the second valve body closer to a second valve seat in the one state than in the other state.

2. The purge control valve device according to claim 1, wherein the first internal passage is disposed upstream of the second internal passage.

3. The purge control valve device according to claim 1, wherein the first electromagnetic valve includes a first passage that functions as the narrowed passage in the unseated state, and a second passage which is larger in passage cross-sectional area than the narrowed passage and through which the evaporative fuel flows in the seated state.

4. The purge control valve device according to claim 1, wherein the first electromagnetic valve includes a first passage that becomes the narrowed passage in the seated state, and a second passage which is larger in passage cross-sectional area than the narrowed passage and through which the evaporative fuel flows in the unseated state.

5. A purge control valve device comprising:

an inflow port into which the evaporative fuel flowing out of a canister flows;

an outlet port through which the evaporative fuel flows out toward an engine;

a housing having an in-housing passage connecting the inflow port and the outflow port;

a first electromagnetic valve provided inside the housing and having a first valve body opening and closing a first internal passage included in the in-housing passage to control a flow rate of the evaporative fuel; and a second electromagnetic valve provided inside the housing and having a second valve body opening and closing a second internal passage included in the in-housing passage to control a flow rate of the evaporative fuel, wherein the first internal passage and the second internal passage are arranged in series in the in-housing passage, the first electromagnetic valve and the second electromagnetic valve are controlled to operate individually, and the first electromagnetic valve is switched between a seated state in which the first valve body contacts a first valve seat and an unseated state in which the first valve body is separated from the first valve seat, the purge control valve device further comprising a narrowed passage in the first internal passage such that a passage cross-sectional area of the first internal passage is smaller in one of the seated state and the unseated state than in another of the seated state and the unseated state, and a valve regulator that moves together with the first valve body in response to an electromagnetic force and regulates a displaceable range of the second valve body, wherein the valve regulator brings the second valve body closer to a second valve seat in the one state than in the other state.

6. The purge control valve device according to claim 5, wherein the first internal passage is disposed upstream of the second internal passage.

7. The purge control valve device according to claim 5, wherein the first electromagnetic valve includes a first passage that functions as the narrowed passage in the unseated state, and a second passage which is larger in passage cross-sectional area than the narrowed passage and through which the evaporative fuel flows in the seated state.

8. The purge control valve device according to claim 5, wherein the first electromagnetic valve includes a first passage that becomes the narrowed passage in the seated state, and a second passage which is larger in passage cross-sectional area than the narrowed passage and through which the evaporative fuel flows in the unseated state.

9. A purge control valve device comprising:

an inflow port into which the evaporative fuel flowing out of a canister flows;

an outlet port through which the evaporative fuel flows out toward an engine;

a housing having an in-housing passage connecting the inflow port and the outflow port;

a first electromagnetic valve provided inside the housing and having a first valve body opening and closing a first internal passage included in the in-housing passage to control a flow rate of the evaporative fuel; and a second electromagnetic valve provided inside the housing and having a second valve body opening and closing a second internal passage included in the in-housing passage to control a flow rate of the evaporative fuel, wherein the first internal passage and the second internal passage are arranged in series in the in-housing passage, the first electromagnetic valve and the second electromagnetic valve are controlled to operate individually, and the first electromagnetic valve is switched between a seated state in which the first valve body contacts a first valve seat and an unseated state in which the first valve body is separated from the first valve seat, the purge control valve device further comprising a narrowed passage in which a flow rate of the evaporative fuel is smaller in one of the seated state and the unseated state than in another of the seated state and the unseated state, and a controller that individually controls the first electromagnetic valve and the second electromagnetic valve when increasing the flow rate of the evaporative fuel such that the controller separately performs a mode of a first increase rate and a mode of a second increase rate that is larger in flow increase rate than the mode of the first increase rate, wherein the controller controls the first electromagnetic valve and the second electromagnetic valve during the mode of the first increase rate such that the evaporative fuel flows through the narrowed passage, and the controller controls the first electromagnetic valve and the second electromagnetic valve during the mode of the second increase rate such that the evaporative fuel flows through an open passage larger in passage cross-sectional area than the narrowed passage.

10. The purge control valve device according to claim 9, wherein the controller executes the mode of the first increase rate and then executes the mode of the second increase rate in a flow-rate increase control in which the flow rate of the evaporative fuel flowing out of the outflow port is increased from zero.

11. The purge control valve device according to claim 9, wherein the controller controls the first electromagnetic valve by turning on and off energization of the first electromagnetic valve, and controls the second electromagnetic valve by controlling a duty cycle of voltage applied to the second electromagnetic valve, and the controller is configured to, in the control of the second electromagnetic valve, increase the duty cycle of the applied voltage in the mode of the first increase rate, reduce the duty cycle of the applied voltage at a time of shifting from the mode of the first increase rate to the mode of the second increase rate, and increase the duty cycle of the applied voltage in the mode of the second increase rate.

12. The purge control valve device according to claim 9, wherein the controller individually controls the first electromagnetic valve and the second electromagnetic valve and performs the mode of the first increase rate when learning a concentration of the evaporative fuel.

13. The purge control valve device according to claim 9, wherein the controller individually controls the first electromagnetic valve and the second electromagnetic valve so as to perform the mode of the first increase rate when a condition for generation of noise is met.

14. A purge control valve device comprising:

an inflow port into which the evaporative fuel flowing out of a canister flows;

an outlet port through which the evaporative fuel flows out toward an engine;

a housing having an in-housing passage connecting the inflow port and the outflow port;

a first electromagnetic valve provided inside the housing and having a first valve body opening and closing a first internal passage included in the in-housing passage to control a flow rate of the evaporative fuel; and a second electromagnetic valve provided inside the housing and having a second valve body opening and closing a second internal passage included in the in-housing passage to control a flow rate of the evaporative fuel, wherein the first internal passage and the second internal passage are arranged in series in the in-housing passage, the first electromagnetic valve and the second electromagnetic valve are controlled to operate individually, and the first electromagnetic valve is switched between a seated state in which the first valve body contacts a first valve seat and an unseated state in which the first valve body is separated from the first valve seat, the purge control valve device further comprising a narrowed passage in the first internal passage such that a passage cross-sectional area of the first internal passage is smaller in one of the seated state and the unseated state than in another of the seated state and the unseated state, and a controller that individually controls the first electromagnetic valve and the second electromagnetic valve when increasing the flow rate of the evaporative fuel such that the controller separately performs a mode of a first increase rate and a mode of a second increase rate that is larger in flow increase rate than the mode of the first increase rate, wherein the controller controls the first electromagnetic valve and the second electromagnetic valve during the mode of the first increase rate such that the evaporative fuel flows through the narrowed passage, and the controller controls the first electromagnetic valve and the second electromagnetic valve during the mode of the second increase rate such that the evaporative fuel flows through an open passage larger in passage cross-sectional area than the narrowed passage.

15. The purge control valve device according to claim 14, wherein the controller executes the mode of the first increase rate and then executes the mode of the second increase rate in a flow-rate increase control in which the flow rate of the evaporative fuel flowing out of the outflow port is increased from zero.

16. The purge control valve device according to claim 14, wherein the controller controls the first electromagnetic valve by turning on and off energization of the first electromagnetic valve, and controls the second electromagnetic valve by controlling a duty cycle of voltage applied to the second electromagnetic valve, and the controller is configured to, in the control of the second electromagnetic valve, increase the duty cycle of the applied voltage in the mode of the first increase rate, reduce the duty cycle of the applied voltage at a time of shifting from the mode of the first increase rate to the mode of the second increase rate, and increase the duty cycle of the applied voltage in the mode of the second increase rate.

17. The purge control valve device according to claim 14, wherein the controller individually controls the first electromagnetic valve and the second electromagnetic valve and performs the mode of the first increase rate when learning a concentration of the evaporative fuel.

18. The purge control valve device according to claim 14, wherein the controller individually controls the first electromagnetic valve and the second electromagnetic valve so as to perform the mode of the first increase rate when a condition for generation of noise is met.

* * * * *